US007880400B2

(12) United States Patent
Zhou et al.

(10) Patent No.: US 7,880,400 B2
(45) Date of Patent: Feb. 1, 2011

(54) DIGITAL DRIVER APPARATUS, METHOD AND SYSTEM FOR SOLID STATE LIGHTING

(75) Inventors: Dongsheng Zhou, San Jose, CA (US); Anatoly Shteynberg, San Jose, CA (US); Harry Rodriguez, Gilroy, CA (US); Mark Eason, Hollister, CA (US); Lanh Nguyen, Santa Clara, CA (US)

(73) Assignee: Exclara, Inc., Santa Clara, CA (US)

( * ) Notice: Subject to any disclaimer, the term of this patent is extended or adjusted under 35 U.S.C. 154(b) by 631 days.

(21) Appl. No.: 11/859,680

(22) Filed: Sep. 21, 2007

(65) Prior Publication Data

US 2009/0079355 A1 Mar. 26, 2009

(51) Int. Cl.
*H05B 41/16* (2006.01)
*G09G 3/36* (2006.01)

(52) U.S. Cl. ..... 315/247; 315/224; 315/291; 315/185 S; 315/307; 345/102; 345/82; 345/212; 345/214

(58) Field of Classification Search ..... 315/247, 315/224, 291, 297, 307–326, 185 S; 345/102, 345/82, 76, 204, 211, 212, 213, 214
See application file for complete search history.

(56) References Cited

U.S. PATENT DOCUMENTS

2007/0267978 A1* 11/2007 Shteynberg et al. ..... 315/247
2009/0322234 A1* 12/2009 Chen et al. ..... 315/159
2010/0164403 A1* 7/2010 Liu ..... 315/297

* cited by examiner

*Primary Examiner*—Tuyet Thi Vo
(74) *Attorney, Agent, or Firm*—Nancy R. Gamburd; Gamburd Law Group LLC

(57) ABSTRACT

An apparatus, method and system are provided for controlling the solid state lighting, such as LEDs. An exemplary apparatus comprises: a switch for switching electrical current through the LEDs, a current sensor; a first comparator adapted to determine when a switch electrical current has reached a first predetermined threshold; a second comparator adapted to determine when the switch electrical current has reached a predetermined average current level; and a controller. The controller is adapted to turn the switch into an on state and an off state, to determine a first on time period as a duration between either a detection of a second predetermined current threshold or the turning the switch into the on state, and the detection of the predetermined average current level; to determine a second on time period as a duration between the detection of the predetermined average current level and the detection of the first predetermined current threshold; and to determine an on time period of the switch as substantially proportional to a sum of the first on time period and the second on time period. Additional exemplary embodiments utilize a difference between the first and second on time periods to generate an error signal to adjust the on time period of the switch.

103 Claims, 10 Drawing Sheets

DIGITAL DRIVER APPARATUS, METHOD AND SYSTEM FOR SOLID STATE LIGHTING

FIELD OF THE INVENTION

The present invention in general is related to supplying and controlling power to solid state lighting devices, and more particularly, to digitally controlling the current of solid state lighting devices such as light emitting diodes utilized in lighting and other applications.

BACKGROUND OF THE INVENTION

Arrays of light emitting diodes ("LEDs") are utilized for a wide variety of applications, including for general lighting and multicolored lighting. Because emitted light intensity is proportional to the average current through an LED (or through a plurality of LEDs connected in series), adjusting the average current through the LED(s) is one typical method of regulating the intensity or the color of the illumination source. Solid state lighting, such as LEDs, are typically coupled to a converter as a power source.

A step-down (Buck) converter can be controlled either in discontinuous conduction mode (DCM) or continuous conduction mode (CCM). Typically DCM is suitable only for low power processing, while CCM mode is utilized for higher power conversion, such as for high brightness LEDs.

In the prior art, a technique referred to as "current programming mode" ("CPM") is utilized in an attempt to simplify compensator designs for the Buck converter, see, e.g., U.S. Pat. Nos. 6,034,517; 4,975,820; 4,672,518; 4,674,020; and 4,717,994. Prior art circuits for this CPM mode typically regulate the inductor current in CCM mode around a set point within the Buck converter. This set point is further manipulated by an outer compensating loop. For a Buck converter implemented with CPM mode, the outer compensating loop can be a single pole network.

A CPM implementation, however, cannot simply utilize a controller for a Buck converter, but must also be accompanied with a circuit implementing DCM. One challenge facing this CCM implementation is that the control system needs to transition between DCM and CCM modes in both directions. Many prior art control systems will oscillate around these two modes, which causes LED current to fluctuate, and which may be visually apparent as flicker, for example. When the outer compensator bandwidth may be low, another problem with this CCM technique is that the LED current may also fluctuate, particularly when the input voltage to the Buck converter contains a high ripple percentage.

Most prior art LED control systems also utilize a "high side sensing" technique, in which the output current of a Buck converter is sensed by a sensing resistor in series with the inductor (see, e.g., U.S. Pat. Nos. 6,853,174; 6,166,528; and 5,600,234). With high side sensing, output current can be regulated accurately, and high side sensing can also be utilized with CPM techniques. In order to overcome the various stability problems and other disadvantages mentioned above, the prior art has utilized various controllers to implement hysteretic (or so called "bang-bang") control to regulate this inductor current.

The high side sensing technique works well when the controller integrated circuit ("IC") can tolerate the Buck converter input voltage range. This is typically not the case for an LED driver, however, which involves input voltages which are much higher than what a controller IC is capable of tolerating or specified to tolerate and, accordingly, such a high side sensing technique cannot be utilized with typical controller ICs.

Various techniques for "low side sensing" are also found in the prior art, in which the sense resistor is in between the main converter switching element (MOSFET) and ground, see, e.g., U.S. Pat. Nos. 6,580,258 and 5,912,552. The low side sensing technique is usually associated with a control method called "constant off time" (U.S. Pat. Nos. 6,580,258 and 5,912,552). Detailed analysis of this constant off time method shows that while it may be suitable for controlling Buck converter output voltage, it exhibits a very large error if it is used for controlling output current, due to converter component and environmental variations (e.g., manufacturing variations, component aging or life span, and environmental conditions such as temperature).

A need remains, therefore, for a control method, apparatus and system, using low side sensing and suitable for IC implementation, that can regulate output current accurately while eliminating those drawbacks caused by existing techniques. Such an apparatus, method and system should provide a simpler controller compared to CPM techniques, and further provide excellent accuracy and not exhibiting the problems associated with prior art techniques such as CPM technique. Such an apparatus, system and method should also control the intensity (brightness) of light emissions for solid state devices such as LEDs, while simultaneously providing for substantial stability of perceived color emission and control over wavelength shifting, over both a range of intensities and a range of LED junction temperatures. Such an apparatus, system and method should be capable of being implemented with few components, and without requiring extensive feedback systems.

SUMMARY OF THE INVENTION

The exemplary embodiments of the present invention provide numerous advantages for providing power to solid state lighting, such as light emitting diodes. The exemplary embodiments allow for energizing one or more LEDs, using digital control and low side sensing, enabling low voltage IC implementations. The exemplary apparatus and system embodiments may be implemented with either fixed or variable frequency switching, and may be implemented with either AC or DC power sources. As a digital implementation, the exemplary embodiments may also be implemented at a reduced cost. The exemplary embodiments also provide for precise current control, within any selected tolerance levels. In addition, the exemplary embodiments also eliminate the required RC filtering of the prior art.

Further advantages of the exemplary embodiments further provide for controlling the intensity of light emissions for solid state devices such as LEDs, while simultaneously providing for substantial stability of perceived color emission, over both a range of intensities and also over a range of LED junction temperatures. The exemplary embodiments provide digital control, without requiring external compensation. The exemplary embodiments do not utilize significant resistive impedances in the current path to the LEDs, resulting in appreciably lower power losses and increased efficiency. The exemplary current regulator embodiments also utilize comparatively fewer components, providing reduced cost and size, while simultaneously increasing efficiency and enabling longer battery life when used in portable devices, for example.

An exemplary embodiment provides a method of controlling solid state lighting, with the solid state lighting coupled to a switch providing an electrical current path, and the solid state lighting having an electrical current. The exemplary method comprises: turning the switch into an on state; detecting when the electrical current has reached a predetermined average current level; detecting when the electrical current has reached a first predetermined current threshold; determining a first on time period as a duration between detection of a second predetermined current level or turning the switch into the on state and the detection of the predetermined average current level; determining a second on time period as a duration between the detection of the predetermined average current level and the detection of the first predetermined current threshold; and determining an on time period of the switch as substantially proportional to a sum of the first on time period and the second on time period. When the on time period has elapsed, the exemplary also provides for turning the switch into an off state. The exemplary method may also provide for detecting when the electrical current has reached the second predetermined current threshold.

The exemplary embodiments may operate in a fixed or variable frequency switching mode. For the fixed frequency switching, subsequent to turning the switch into the off state, when a fixed time period has elapsed from having turned the switch into the on state, the exemplary method again turns the switch into an on state and repeats the detection and determination steps. For this exemplary embodiment, the method also provides for generating an error signal as a difference between the second on time period and the first on time period, and adjusting the on time period proportionally to the error signal.

For variable frequency switching, when a current off time period has elapsed, the exemplary method provides for determining the current off time period of the switch as a function of the first on time period and the second on time period, and more particularly, determining the current off time period of the switch as a function of the first on time period, the second on time period, and a previous off time period. In an exemplary embodiment, the current off time period of the switch may be determined as:

$$T_{OFF}(K+1) \approx \frac{2 \cdot T_{ON2}(K) \cdot T_{OFF}(K)}{T_{ON1}(K+1) + T_{ON2}(K)},$$

in which $T_{OFF}(K+1)$ is the current off time period, $T_{ON2}(K)$ is a previous second on time period, $T_{OFF}(K)$ is a previous off time period, and $T_{ON1}(K+1)$ is a current first on time period. In another exemplary embodiment, the current off time period of the switch may be determined as:

$$T_{OFF}(K+1) \approx \frac{(T_{ON1}(K)_A + T_{ON2}(K)) \cdot T_{OFF}(K)}{T_{ON1}(K+1) + T_{ON2}(K)},$$

in which $T_{OFF}(K+1)$ is the current off time period, $T_{ON1}(K)_A$ is a previous first on time period determined using the detection of the second predetermined current level, $T_{ON2}(K)$ is a previous second on time period, $T_{OFF}(K)$ is a previous off time period, and $T_{ON1}(K+1)$ is a current first on time period. In another exemplary embodiment, the current off time period of the switch may be determined as a function of a current first on time period, a previous second on time period, and a previous off time period, or as a function of a current first on time period, a previous first on time period, a previous second on time period, and a previous off time period.

In another exemplary embodiment, the method includes adjusting the current off time period to provide that the first on time period is substantially equal to the second on time period. In addition, the exemplary method also provides for decreasing the current off time period proportionally to a driving gate rising edge time period, or decreasing the on time period proportionally to a driving gate falling edge time period and a comparator falling edge time period. In another variation, the exemplary method may include adjusting the second on time period proportionally to a driving gate falling edge time period, or decreasing the second on time period proportionally to a driving gate falling edge time period and a comparator falling edge time period.

The exemplary method also provides for determining a blanking time interval following turning the switch into the on state. During the blanking time interval, the exemplary method provides for ignoring the detection of the second predetermined current threshold, the detection of the predetermined average current level, or the detection of the first predetermined current threshold. The blanking time interval may be determined as proportional to a gate rising edge time period and a transient current time period, or as proportional to a gate rising edge time period and detection of the predetermined average current level, for example.

In another exemplary embodiment, the exemplary method includes adjusting a brightness level of the solid state lighting by using at least two different and opposing electrical biasing techniques. In addition, the method of adjusting a brightness level of the solid state lighting may include using a hysteresis of at least two electrical current amplitude levels and at least two electrical current duty cycle ratios.

In an exemplary embodiment, the solid state lighting comprises at least one light emitting diode which has a comparatively high voltage node and a comparatively low voltage node, and wherein the detection of the second predetermined current threshold, the detection of the predetermined average current level, and the detection of the first predetermined current threshold occur at the comparatively low voltage node.

In another exemplary embodiment, the solid state lighting comprises a plurality of arrays of a plurality of series-connected light emitting diodes, and each array of the plurality of arrays further coupled to a corresponding switch providing an electrical current path. The exemplary method may also include separately determining a corresponding first on time period, a corresponding second on time period, and a corresponding on time period as substantially proportional to the sum of the corresponding first on time period and the corresponding second on time period for each array of the plurality of arrays; when the corresponding on time period has elapsed, separately turning the corresponding switch into an off state; and separately determining a corresponding off time period for each array of the plurality of arrays. In addition, the exemplary method may also include interleaving the corresponding on time periods of the corresponding switches of the plurality of arrays, such as by successively switching electrical current to each array of the plurality of arrays for the corresponding on time period.

Another exemplary embodiment provides an apparatus for controlling solid state lighting, with the apparatus comprising: a switch couplable to the solid state lighting; a first comparator adapted to determine when a switch electrical current has reached a first predetermined current threshold; a second comparator adapted to determine when the switch electrical current has reached a predetermined average current level; and a controller coupled to the first comparator and to the second comparator. In an exemplary embodiment, the controller is adapted to turn the switch into an on state and an off state, to determine a first on time period as a duration between either a detection of a second predetermined current threshold or the turning the switch into the on state, and the detection of the predetermined average current level; to determine a second on time period as a duration between the detection of the predetermined average current level and the detection of the first predetermined current threshold; and to determine an on time period of the switch as substantially proportional to a sum of the first on time period and the second on time period. The controller is further adapted to perform the methodology discussed above.

In an exemplary embodiment, the apparatus also includes a gate driver circuit coupled between the controller and the switch, and wherein the controller is adapted to turn the switch on and to turn the switch off by generating a corresponding signal to the gate driver circuit. The exemplary apparatus may also include a third comparator adapted to determine when the electrical current has reached the second predetermined current threshold; a reference voltage generator adapted to provide reference voltages respectively corresponding to the first and second predetermined current thresholds and to the predetermined average current level; an input-output interface coupled to the controller and adapted to receive an input control signal; and a current sensor coupled to the first and second comparators and to the switch. An exemplary current sensor is embodied as a resistive circuit element.

When the solid state lighting comprises a plurality of arrays of a plurality of series-connected light emitting diodes, with each array of the plurality of arrays is further coupled to a corresponding switch, the controller is further adapted to turn each corresponding switch into an on state and an off state; to separately determine a corresponding first on time period, a corresponding second on time period, and a corresponding on time period as substantially proportional to the sum of the corresponding first on time period and the corresponding second on time period for each array of the plurality of arrays; when the corresponding on time period has elapsed, to separately turn the corresponding switch into an off state; to separately determine a corresponding off time period for each array of the plurality of arrays; and to interleave the corresponding on time periods of the corresponding switches of the plurality of arrays, such as by successively turn into an on state each corresponding switch for each array of the plurality of arrays for the corresponding on time period.

The exemplary embodiments also provide a solid state lighting system, the system couplable to a power source, with the system comprising: a plurality of arrays of series-connected light emitting diodes; a plurality of switches, a corresponding switch of the plurality of switches coupled to each the array of the plurality of arrays of light emitting diodes; at least one corresponding first comparator adapted to determine when a corresponding switch electrical current has reached a corresponding first predetermined current threshold; at least one corresponding second comparator adapted to determine when the corresponding switch electrical current has reached a corresponding predetermined average current level; and at least one controller coupled to the corresponding first comparator and to the corresponding second comparator, the controller adapted to turn the corresponding switch into an on state and an off state, to determine a corresponding first on time period as a duration between either a detection of a corresponding second predetermined current threshold or the turning the corresponding switch into the on state, and the detection of the corresponding predetermined average current level; to determine a corresponding second on time period as a duration between the detection of the corresponding predetermined average current level and the detection of the corresponding first predetermined current threshold; and to determine a corresponding on time period of the corresponding switch as substantially proportional to a sum of the corresponding first on time period and the corresponding second on time period. The exemplary controller is also adapted to separately perform the methodology of the invention for each array, including the interleaving and the other features discussed above and below.

In addition, in the exemplary system, the exemplary apparatus may be coupled to a DC-DC power converter receiving a DC input voltage or coupled to AC-DC power converter receiving a rectified AC input voltage. When the power source provides a rectified AC input voltage, an electrical current through a corresponding switch is substantially zero when the rectified AC input voltage is below a selected or predetermined threshold. In addition, when the power source provides a rectified AC input voltage, the at least one controller is in an off state when the rectified AC input voltage is below a selected or predetermined threshold.

Another exemplary embodiment includes an apparatus for controlling solid state lighting, with the apparatus comprising: a switch couplable to the solid state lighting; a current sensor coupled to the switch; a first comparator adapted to determine when a switch electrical current has reached a first predetermined current threshold; a second comparator adapted to determine when the switch electrical current has reached a predetermined average current level; a third comparator adapted to determine when the switch electrical current has reached a second predetermined current threshold; a reference voltage generator coupled to the first, second and third comparators and adapted to provide reference voltages respectively corresponding to the first predetermined current threshold, the second predetermined current threshold; and to the predetermined average current level; an input-output interface adapted to receive an input control signal; and a controller coupled to the first, second and third comparators and to the input-output interface, the controller adapted to turn the switch into an on state and an off state, to determine a first on time period as a duration between either the detection of a second predetermined current threshold or the turning the switch into the on state, and the detection of the predetermined average current level; to determine a second on time period as a duration between the detection of the predetermined average current level and the detection of the first predetermined current threshold; to determine an on time period of the switch as substantially proportional to a sum of the first on time period and the second on time period; to turn the switch into an off state when the on time period has elapsed; and to determine a current off time period of the switch as a function of the first on time period, the second on time period, and a previous off time period.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which:

FIG. 2, divided into

DETAILED DESCRIPTION OF EXEMPLARY EMBODIMENTS

Figure 1:
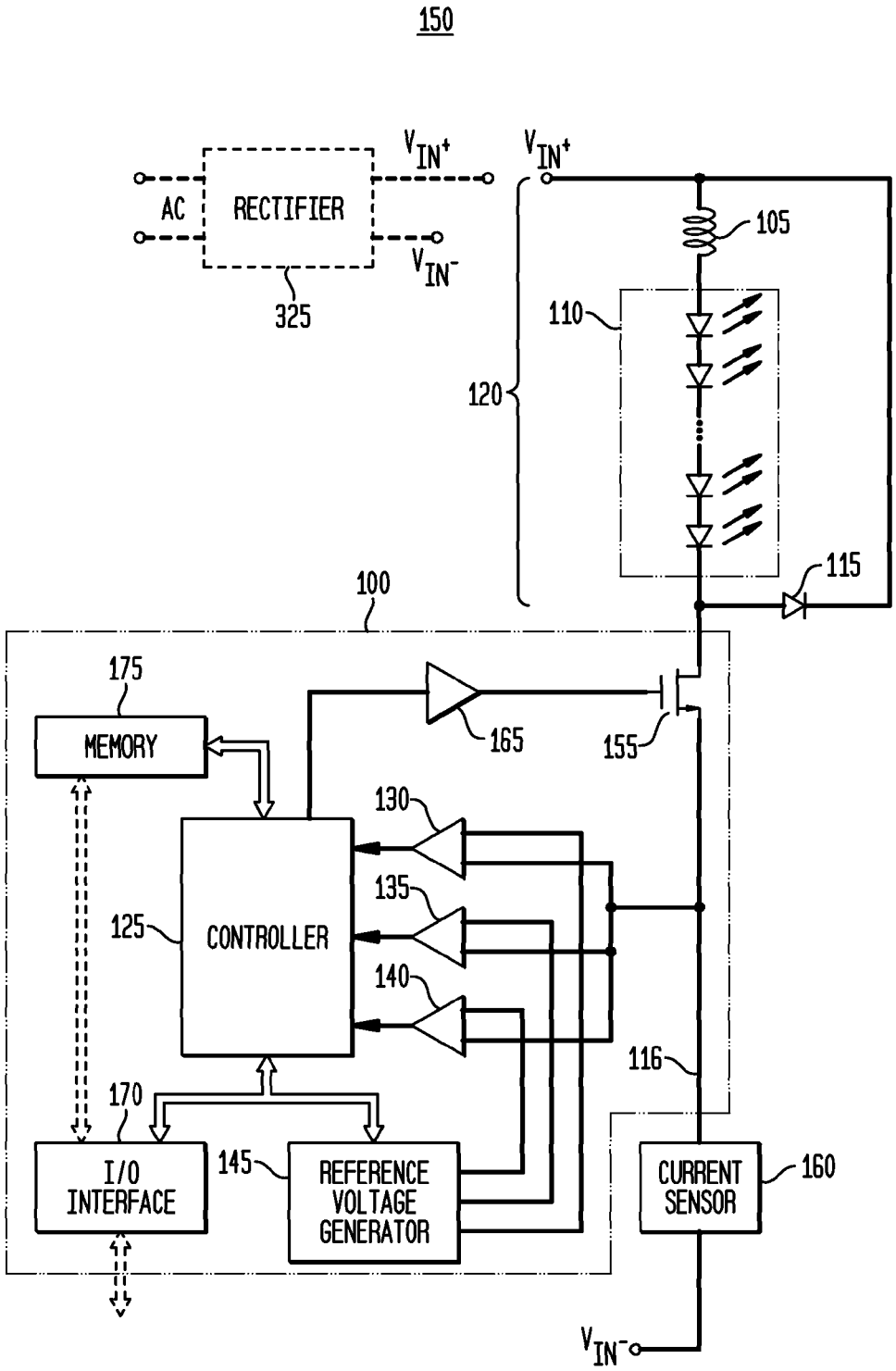
FIG. 1 is a block and circuit diagram of an exemplary first system embodiment and first apparatus embodiment in accordance with the teachings of the present invention.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

As mentioned above, exemplary embodiments of the present invention provide numerous advantages for providing power to solid state lighting, such as light emitting diodes. The exemplary embodiments allow for energizing one or more LEDs, using digital control and low side sensing, enabling low voltage IC implementations. The exemplary apparatus and system embodiments may be implemented with either fixed or variable frequency switching, and may be implemented with either AC or DC power sources. As a digital implementation, the exemplary embodiments may also be implemented at a reduced cost. The exemplary embodiments also provide for precise current control, within any selected tolerance levels. In addition, the exemplary embodiments also eliminate the required RC filtering of the prior art. Further advantages are discussed below.

FIG. 1 is a block and circuit diagram of an exemplary first system 150 embodiment and first apparatus 100 embodiment in accordance with the teachings of the present invention, for a single channel of LEDs 110. As illustrated in FIG. 1, the system 150 comprises an apparatus 100, a converter 120 with an array of LEDs 110 (as an exemplary type of solid state lighting), and a current sensor 160 (illustrated in FIG. 8 as implemented using a resistor $\mathbf{160}_A$). The illustrated configuration for the converter 120 is a Buck converter, although many other configurations and types of converters may be utilized equivalently, requiring only the capability for "low side" (node 116) current sensing, i.e., current sensor 160 is on the comparatively low side (e.g., at node 116) of the power converter 120, as described in greater detail below. The converter 120 comprises an inductor 105 and a diode 115, with the inductor 105 having a series connection with the LEDs 110. The switch 155 may be considered part of the apparatus 100 or part of the converter 120. As known in the art, other components may also be included within the converter 120, and are also within the scope of the present invention.

The apparatus 100, also referred to as a "digital LED driver", comprises a controller 125, a plurality of comparators 130, 135, 140, and a reference voltage generator 145. The comparators 130, 135, 140 and reference voltage generator 145 may be implemented as known or becomes known in the electronic arts. Optionally, the apparatus 100 may also include an input-output ("I/O") interface 170, to receive (and/or transmit) various signals, such as on, off, brightness (dimming) information, or other control information (such as from a building control system), and may communicate using any protocol, as described below. The apparatus 100 also may include a memory 175, such as to store settings, values, and other parameters which may be used by the controller 125, and which also may have a connection to the I/O interface 170, for input or modification of such parameters. Various implementations of the controller 125 (and other controller 225 embodiments), the I/O interface 170, and the memory 175 are described in greater detail below. A switch 155, typically implemented as a field effect transistor ("FET") or any other type of transistor or switching device, may be considered to be part of either the apparatus 100, the converter 120, or the system 150, and is controlled by the controller 125, typically through an optional gate driver (buffer) 165. The current sensor 160 also may be considered to be part of either the apparatus 100 or the system 150. Those of skill in the art will recognize that the current sensor 160 may be implemented in innumerable ways, in addition to the illustrated resistor (FIG. 8), and any and all of which are considered equivalent and within the scope of the invention. Not separately illustrated in FIG. 1 are the typical power (Vdd and/or $V_{IN}$), ground, and clock (oscillator) inputs and connections for the apparatus 100. In addition, either terminal illustrated as $V_{IN}^-$ or $V_{IN}^+$ may also be a ground (GND) connection (e.g., $V_{IN}^+$ and GND, or GND and $V_{IN}^-$). Also as illustrated, $V_{IN}^+$ and $V_{IN}^-$ may be a DC voltage or a rectified AC (AC line voltage), using an optional rectifier 325. Exemplary current waveforms for an AC implementation are illustrated and discussed below with reference to FIG. 9.

Figures 2A, 2B:
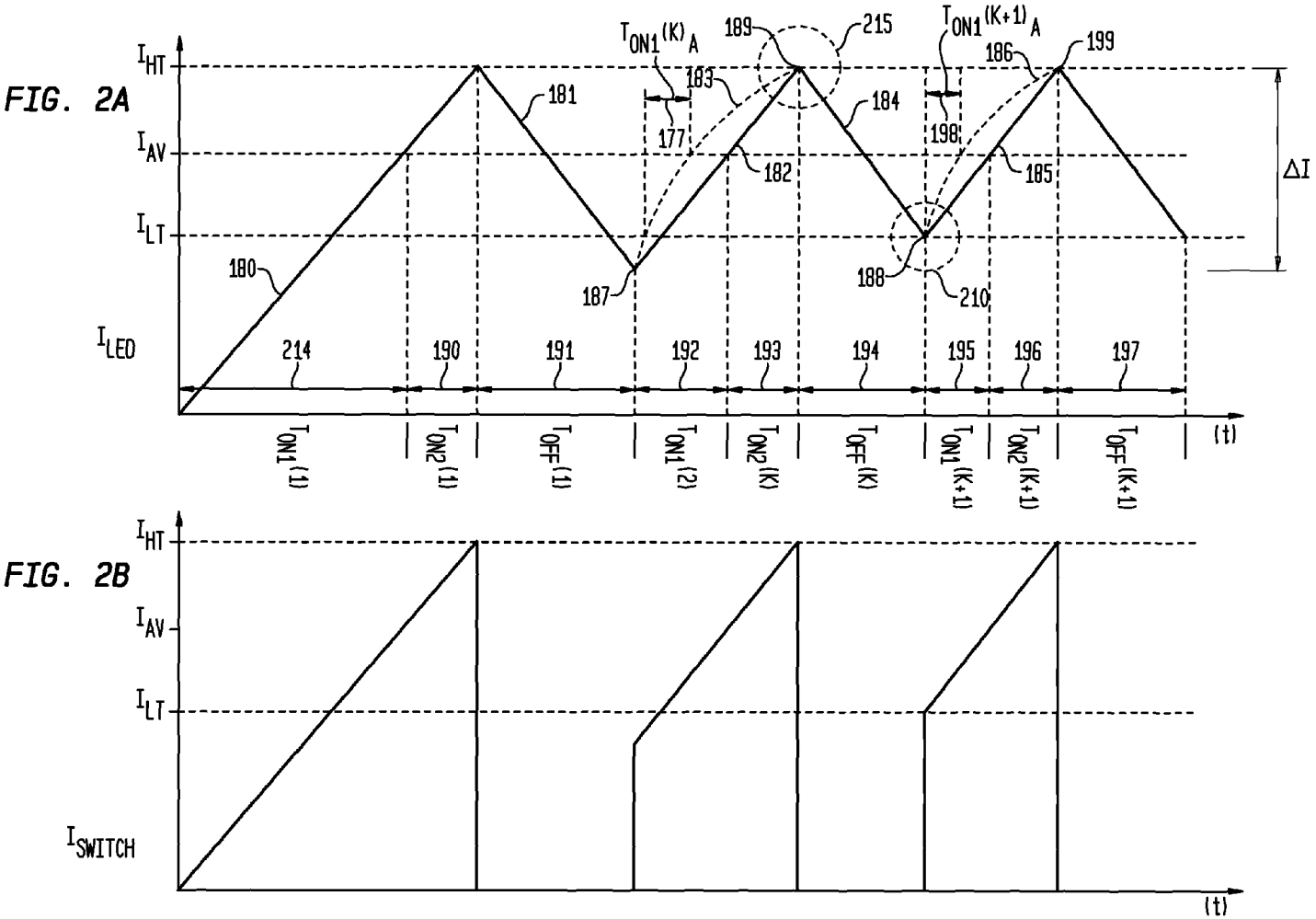
FIGS. 2A and 2B, are graphical diagrams illustrating a first exemplary current waveform through the solid state lighting and through a switch, respectively, in accordance with the teachings of the present invention.

As mentioned above, the apparatus 100 implements "low-side" sensing, such that voltages are detected on the "low" side of LEDs 110, compared to prior art "high-side" sensing of inductor 105 (or LED 110) current. Accordingly, the apparatus 100 is not required to tolerate high voltages which would be necessary with high-side sensing. The apparatus 100 operates by detecting various LED 110 current levels when the switch 155 is on and conducting, and by the controller 125 calculating and predicting optimal switch 155 "on time" durations ("$T_{ON}$") (divided into first and second portions) and switch 155 "off time" durations ("$T_{OFF}$"). By controlling the on and off durations of the switch 155, the controller 125 thereby regulates the current through the LEDs 110, with current increasing during the on time, and decreasing during the off time (and flowing through diode 115, rather than the switch 155), as illustrated in FIG. 2A. In addition, for these first system and apparatus embodiments, because the combined duration (arithmetic sum) of the on ($T_{ON}$) and off ($T_{OFF}$) times for the LEDs 110 is not constant, but is variable, the system 150 has a variable switching frequency (a constant switching frequency is discussed below with reference to FIG. 8). The LED 110 current levels are detected as corresponding voltage levels across the current sensor 160 during the on time, and compared by the plurality of comparators 130, 135, 140, to corresponding reference voltages generated by reference voltage generator 145. When the switch 155 is off and not conducting, however, it should be noted that no current flow through or otherwise will be available to the current sensor 160 (switch 155 current falls to zero during $T_{OFF}$, as illustrated in FIG. 2B), and as a consequence, the comparators 130, 135, 140, will not have corresponding voltage input and will therefore have a low (binary zero) output. Described another way, during the off time of the switch 155, the comparators 130, 135, 140 are not providing any (valid) information concerning the LED 110 current levels.

In accordance with the present invention, the controller 125 will determine various "on" times of the switch 155 to provide a selected or predetermined average current level through the LEDs 110, which current is further less than a selected or predetermined first, high threshold level and greater than a selected or predetermined second, low threshold level, thereby regulating average current through the LEDs 110 with a predetermined current ripple level. A first comparator 130 is utilized to detect the first, high threshold ("HT") level, typically as a voltage across the current sensor 160, by comparing the voltage level across the current sensor 160 with a first reference voltage level provided by the reference voltage generator 145. A second comparator 135 is utilized to detect the second, low threshold ("LT") level, by comparing the voltage level across the current sensor 160 with a second reference voltage level provided by the reference voltage generator 145, and a third comparator 140 is utilized to detect the third, average level, by comparing the voltage level across the current sensor 160 with a third (e.g., average ("AV")) reference voltage level provided by the reference voltage generator 145. Based upon those detected levels, the controller 125 will determine the accurate (and optimal) on time durations for the switch 155. Using those switch 155 on time durations, and a current "off" time duration (which at initial start up may be a default value), the controller 125 will calculate a next off time duration. Quite rapidly and within very few on and off cycles of the switch 155, the controller 125 will cause the on and off durations of the switch 155 to converge to accurate (and optimal) values, and further, to provide any corrections within very few clock cycles, such as due to potentially fluctuating input voltage levels ($V_{IN}^+$ and/or $V_{IN}^-$).

FIG. 2, divided into FIGS. 2A and 2B, are graphical diagrams illustrating a first exemplary current waveform through the solid state lighting (LEDs 110) (and being equal to the current through the inductor 105) and through the switch 155, respectively, in accordance with the teachings of the present invention. As illustrated in FIG. 2A, during initial start up, the switch 155 is on ($T_{ON1}$(1), interval 214), and the current through the LEDs 110 will increase (180). During this time period, as the current increases and the voltage across the current sensor 160 increases, the voltage level across the current sensor 160 will be compared by the comparators 130, 135, 140. As the various threshold levels are reached, the comparators 130, 135, 140 will provide corresponding signals to the controller 125, and the controller 125, in turn, is adapted to determine the corresponding time intervals (durations) for the current to increase, for example, either from when the switch 155 has been turned on to the third, average current level (signal from the third comparator 140) ($T_{ON1}$(K)), or from the second, low threshold (signal from second comparator 135) to the third, average current level (also a signal from the third comparator 140) ($T_{ON1}(K)_A$), and then from the third, average current level to the first, high threshold level ($T_{ON2}$) (signal from the first comparator 130). Upon reaching the first, high threshold, the first comparator 130 will provide a corresponding signal to the controller 125, which will then turn off the switch 155, typically via the gate driver 165, and the current through the LEDs 110 will begin to decrease (181). During initial start up ($T_{ON1}$(1)), the $T_{ON1}$(1) interval is not utilized (e.g., insufficiently accurate, due to the start up time), and a default off time is implemented ($T_{OFF}$ (1)), such that following the default interval, the switch 155 will be turned on again (187).

In accordance with the exemplary embodiments, the on time of the switch 155 is divided into two intervals, $T_{ON1}$(K) and $T_{ON2}$(K), indexed for each switching cycle "K" of the switch 155, with consecutive cycles referred to as "K" and "K+1", with $T_{ON1}$(K) being the time interval commencing with turning on the switch 155 and ending with the LED 110 current reaching the third, average current level ($I_{AV}$), and with $T_{ON2}$(K) being the time interval commencing with the current having reached the third, average current level ($I_{AV}$) and ending with the LED 110 current reaching the first, high threshold current level ($I_{HT}$). In addition, to accommodate various input ($V_{IN}^+$) and output ($V_O$) voltage levels, another $T_{ON1}$ time interval is utilized, illustrated in FIG. 2A as $T_{ON1}(K)_A$ (177) and $T_{ON1}(K+1)_A$ (198), which is the time interval commencing with the LED 110 current reaching the second, low threshold current level ($I_{LT}$) and ending with the LED 110 current reaching the third, average current level ($I_{AV}$). The $T_{ON1}(K)_A$ and $T_{ON1}(K+1)_A$ time periods are utilized for the non-linear rising of the inductor 105 current, illustrated as curves 183, 186 in FIG. 2A. The alternative first on time, $T_{ON1}(K)_A$, from the second, low threshold ($I_{LT}$) to the third, average current level ($I_{AV}$), also may be utilized generally when valid second, low threshold ($I_{LT}$) information is obtainable (depending upon whether the low threshold has already been reached when the blanking time interval has elapsed, as discussed below). Also in accordance with the exemplary embodiments, as the apparatus 100 has a few cycles of operation, the time at which the switch 155 is turned on will be at about the second, low threshold current level ($I_{LT}$).

When the switch 155 is turned on again (187), depending on the input ($V_{IN}^+$) and output ($V_O$) voltage levels, the increase in current through LEDs 110 may be comparatively linear (182, 185), typically for the input voltage $V_{IN}^+$ being significantly greater than the output voltage $V_O$, or may be nonlinear (183, 186), typically for the input voltage $V_{IN}^+$ being comparatively close in value to the output voltage $V_O$. The exemplary embodiments of the present invention provide current control for and regardless of either the linear or the nonlinear situation. As the current increases, based upon the input from the comparators 130, 135, 140, the controller 125 will determine the time intervals (durations) $T_{ON1}(K)$ and $T_{ON2}(K)$. When the first, high threshold has been reached, the controller 125 will again turn off the switch 155 (189, 199), and will calculate the next off duration for the switch 155 (to be utilized currently), such that the LED current level is generally kept above the second, low threshold (188), and does not have undershoot (or has insignificant undershoot) (as may have occurred previously (187) during initial start up, as illustrated).

The controller 125, generally, will determine a current off time of the switch 155 as a function of the on time and the previous off time. More specifically, the controller 125 will determine a current off time period of the switch as a function of the first on time period, the second on time period, and a previous off time period. Even more specifically, the controller 125 will determine a current off time period of the switch as a function of a current first on time period, a previous second on time period, and a previous off time period. In another alternative, and also more specifically, the controller 125 will determine a current off time period of the switch as a function of a current first on time period, a previous first on time period, a previous second on time period, and a previous off time period. In addition, current and previous should be understood in their relative sense, which are also pair-wise equivalent to the relative terms next and current (respectively, as a pair), so that any reference or claim to current and previous should be understood to mean and include next and current, respectively.

During any given cycle, at the point of turning off the switch 155 (189, 199), the current values (or parameters) for $T_{ON1}(K+1)$, $T_{ON2}(K+1)$ and the previous values (or parameters) for $T_{ON1}(K)$, $T_{ON2}(K)$, and $T_{OFF}(K)$ are known. In accordance with the exemplary embodiments, the next off time ($T_{OFF}(K+1)$) which will be utilized in the current cycle (K+1) will be calculated or otherwise determined by the controller 125 using the previous off time ($T_{OFF}(K)$), and the various on times, such as the previous second on time $T_{ON2}(K)$ and the current first on time $T_{ON1}(K+1)$, or the previous second on time $T_{ON2}(K)$, the current first on time $T_{ON1}(K+1)$ and the previous first on time $T_{ON1}(K)_A$. More specifically, in accordance with the invention, the switch 155 off time ($T_{OFF}(K)$) is adjusted such that the first and second on times are generally about or substantially equal to each other, $T_{ON1}(K) \approx T_{ON2}(K)$, which then provides the desired current regulation, maintaining the average current level ($I_{AV}$), while generally maintaining the current below the first, high threshold ($I_{HT}$) and above the second, low threshold ($I_{LT}$), depending upon the allowed or tolerated current ripple level.

When $V_{IN}$ is significantly higher than $V_O$, the inductor 105 current rise slope generally is substantially linear (182, 185). We may assume that the converter 120 input and output voltages $V_{IN}$ and $V_O$ do not vary between consecutive cycles. For a Buck converter, the current rising slope is defined by (Equation 1):

$$\text{current_rising_slope} = \frac{V_{IN} - V_o}{L},$$

such that the current rising slope does not vary appreciably between consecutive cycles. Since comparators 130, 135, 140 are comparing against fixed thresholds $I_{HT}$, $I_{LT}$ and $I_{AV}$, $T_{ON2}$ should remain the same across the consecutive cycles, i.e., (Equation 2):

$$T_{ON2}(K+1)=T_{ON2}(K),$$

such that any calculation using a current second on time $T_{ON2}(K+1)$ is equivalent to and includes using a previous second on time period $T_{ON2}(K)$, and vice versa. By the time $T_{ON1}(K+1)$ elapses, the controller 125 knows $T_{OFF}(K)$, $T_{ON2}(K)$ and $T_{ON1}(K+1)$. Since $T_{OFF}(K)$, $T_{ON1}(K+1)$, and $T_{ON2}(K+1)$ (which equals $T_{ON2}(K)$ from Equation 2) share the same peak ($I_{HT}$) and valley ($I_{LT}$) currents, then (Equation 3)

$$\begin{aligned}\Delta I &= \frac{V_o}{L} T_{OFF}(K) \\ &= \frac{V_{in} - V_o}{L}\{T_{ON1}(K+1) + T_{ON2}(K+1)\} \\ &\approx \frac{V_{in} - V_o}{L}\{T_{ON1}(K+1) + T_{ON2}(K)\}.\end{aligned}$$

Because an average current of $I_{AV}$ and equal halves (time intervals) for of peak ($I_{HT}$) and valley ($I_{LT}$) currents are desired, then (Equation 4):

$$T_{ON1}(K+1)=T_{ON2}(K).$$

The desired $T_{OFF}(K+1)$ can be formulated as (Equation 5):

$$\Delta I_{desired} = \frac{V_o}{L} T_{OFF}(K+1) = \frac{V_{IN} - V_o}{L}\{2 \cdot T_{ON2}(K)\}.$$

Dividing Equation 5 by Equation 3 (i.e., Equation 5 over Equation 3) to remove a dependence over $V_{IN}$, $V_O$ and L, yields (Equation 6):

$$\frac{T_{OFF}(K+1)}{T_{OFF}(K)} = \frac{2 \cdot T_{ON2}(K)}{T_{ON1}(K+1) + T_{ON2}(K)}.$$

Thus, for an exemplary embodiment, the next $T_{OFF}(K+1)$ should be generated by the controller 125 as (Equation 7):

$$T_{OFF}(K+1) = \frac{2 \cdot T_{ON2}(K) \cdot T_{OFF}(K)}{T_{ON1}(K+1) + T_{ON2}(K)}.$$

Implementation of Equation 7 requires one multiply, one shift, one addition and one divide operation per converter 120 switching cycle. The performance of the apparatus 100, therefore, is about two switching cycles to converge to its target values or parameters for $I_{AV}$, $I_{HT}$, and $I_{LT}$. In addition, the requirement of one multiply and divide per converter 120 switching cycle can be relaxed if the converter 120 switching frequency is much higher than normal ripple found in $V_{IN}$ and $V_O$. As mentioned above, however, when the current first on time $T_{ON1}(K+1)_A$ or previous first on time $T_{ON1}(K)_A$ are available (i.e., may be measured after the blanking interval described below), these measurements may be utilized instead of the current first on time $T_{ON1}(K+1)$ or previous first on time $T_{ON1}(K)$.

When $V_{IN}$ is not much higher than $V_O$, the rising slope of the inductor 105 current is no longer linear (183, 186 in FIG. 2A). Typically, the initial slope during the $T_{ON1}(K)$ interval is steeper than the $T_{ON2}(K)$ interval. Because in this case Equation 7 may yield a much lower valley ($I_{LT}$) current than the desired average current $I_{AV}$, Equation 7 can be modified as (Equation 8):

$$T_{OFF}(K+1) = \frac{(T_{ON1}(K)_A + T_{ON2}(K)) \cdot T_{OFF}(K)}{T_{ON1}(K+1) + T_{ON2}(K)}$$

As mentioned above, $T_{ON1}(K)_A$ is the time interval from $I_{LT}$ to $I_{AV}$, and may be determined along curves 183, 186 or the curves 182, 185. As discussed in greater detail below, however, because the controller 125 of various exemplary embodiments does not utilize any output of comparators 130, 135, 140 during a "blanking" interval following turning on the switch 155, it is possible that the output of the second comparator 135 ($I_{LT}$) may be already high when the blanking interval has elapsed and, in which case, Equation 7 is utilized to calculate $T_{OFF}$ (K+1) as well, rather than Equation 8.

Referring again to FIG. 1, the thresholds (peak ($I_{HT}$), valley ($I_{LT}$) and average ($I_{AV}$) currents used by comparators 130, 135, 140 are set (predetermined) within the apparatus 100, such as by inputting values using the I/O interface 170, and storing those values as parameters or values in memory 175. For example, for an allowable or selectable 20% ripple in LED 110 current regulation, peak ($I_{HT}$), average ($I_{AV}$) and valley ($I_{LT}$) currents can be set to be apart by 10% intervals. Typical values for peak ($I_{HT}$), average ($I_{AV}$) and valley ($I_{LT}$) currents are represented by corresponding voltages across the current sensor 160, e.g., at around 0.3 Volts (and can be lower when using an IC). The current sensor 160 is selected based upon the desired application; for example, when implemented as a resistor, a value is selected to pass a desired average current.

Figure 3:
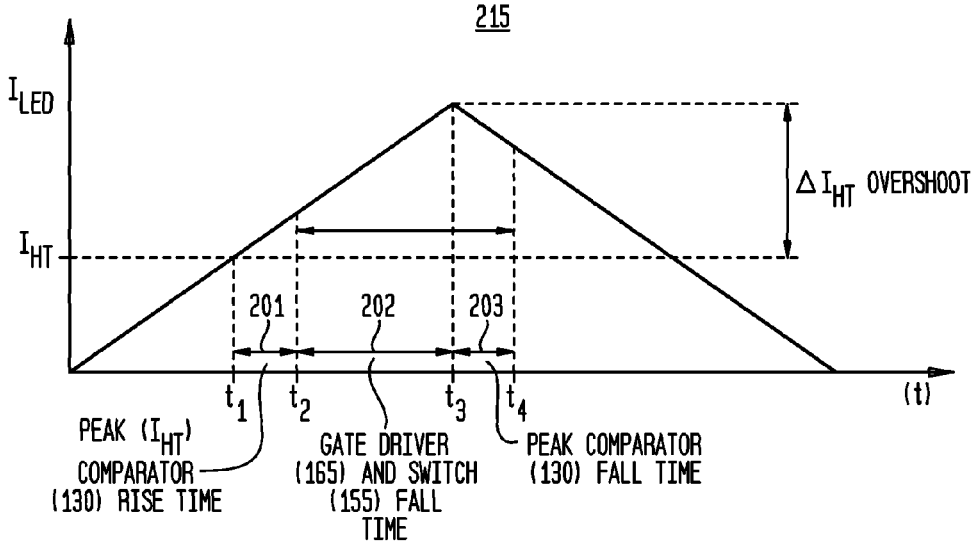
FIG. 3 is a graphical diagram illustrating an exemplary current waveform of a solid state lighting current overshoot, in accordance with the teachings of the present invention.
Figure 4:
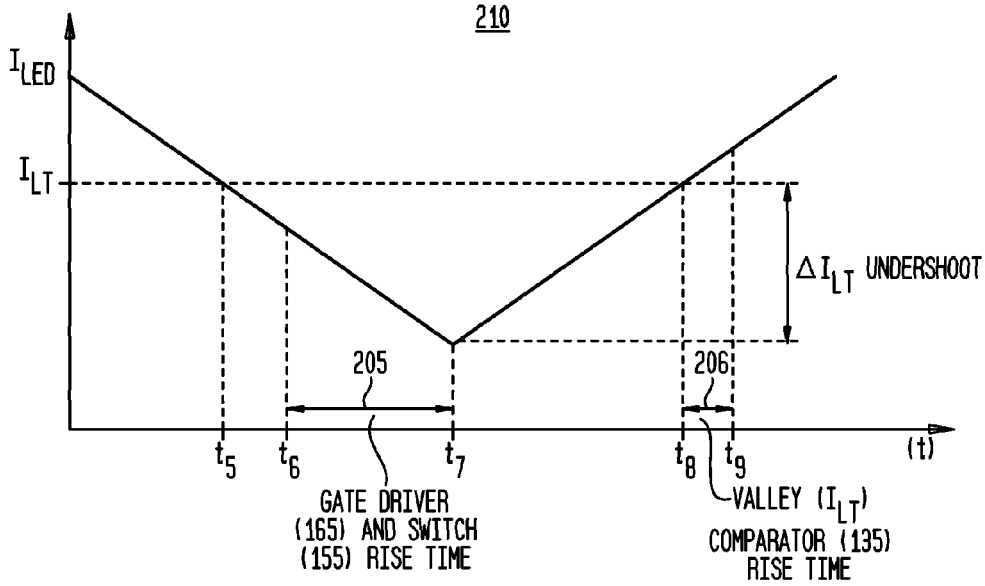
FIG. 4 is a graphical diagram illustrating an exemplary current waveform of a solid state lighting current undershoot, in accordance with the teachings of the present invention.

For even more fine-grained current regulation, the exemplary embodiments of the invention also account for rise and fall delays of the various switching elements, such as the rising and falling time delays of the switch 155, the gate driver 165, and the comparators 130, 135, 140, with any propagation delays included within any such rising and falling time delays. FIG. 3 is a graphical diagram illustrating an exemplary current waveform of a solid state lighting current overshoot, in accordance with the teachings of the present invention, illustrating in greater detail section 215 from FIG. 2. FIG. 4 is a graphical diagram illustrating an exemplary current waveform of a solid state lighting current undershoot, in accordance with the teachings of the present invention, illustrating in greater detail section 210 from FIG. 2.

Referring to FIG. 3, when the LED 110 current reaches the first, high threshold ($I_{HT}$) at time $t_1$, there is a rise time associated with the first (peak) comparator 130 (interval 201), such that the controller 125 does not receive the corresponding information until time $t_2$. At time $t_2$, the controller 125 will turn off the gate driver 165 to turn off the switch 155, resulting in a fall time associated with the gate driver 165 and the switch 155 (interval 202), such that the switch 155 has stopped conducting at time $t_3$. As the current through the LEDs 110 (and switch 155) decreases, there is another fall time associated with the first (peak) comparator 130 (interval 203), such that the controller 125 does not receive the corresponding information until time $t_4$. Because of these rising and falling time delays, unless the delays are accounted for, there can be an overshoot of the LED 110 current, with the LED 110 current being higher than the selected first, high threshold. Accordingly, the controller 125 receives the corresponding comparator (130) rising and falling edge information at $t_2$ and $t_4$.

Similarly, referring to FIG. 4, when the LED 110 current decreases to the second, low threshold ($I_{LT}$) during an off time period, no current is flowing through the switch 155 (FIG. 2B), so no information is available to the controller 125. At time $t_6$, the end of the off time period, the controller 125 will turn on the gate driver 165 to turn on the switch 155, resulting in a rise time associated with the gate driver 165 and the switch 155 (interval 205), such that the switch 155 will start conducting at time $t_7$. As the current through the LEDs 110 (and switch 155) increases to the low threshold ($t_8$), there is a rise time associated with the second (valley) comparator 135 (interval 206), such that the controller 125 does not receive the corresponding information until time $t_9$. Because of these rising and falling time delays, unless the delays are accounted for, there can be an undershoot of the LED 110 current, with the LED 110 current being lower than the selected second, low threshold. Accordingly, the controller 125 receives the corresponding comparator (135) rising edge information at $t_9$.

The exemplary embodiments of the invention may be implemented to account the various delays associated with the rising and falling times of the first (peak) comparator 130, the gate driver 165 and the switch 155, and the second (valley) comparator 135. By making the rising and falling delay times equal (symmetrical) for each comparator 130, 135, then the time interval during which the controller 125 receives the corresponding comparator (130, 135) rising and falling edge information (e.g., at $t_2$ and $t_4$) is equal to the actual overshoot time interval (of $t_1$ to $t_3$). Accordingly, the overshoot time may be measured from the first comparator 130 rising edge ($t_2$) (also coincident with the falling edge of the off command/signal to the gate driver 165) to the first (peak) comparator 130 falling edge ($t_4$), resulting in (Equation 9):

$$T_{overshoot} \approx T_{p_gate_drive_fall} + T_{pk_comp_fall}.$$

Accordingly, for finer-grained control, the overshoot time is subtracted from $T_{ON2}$ by the controller 125, such that the actual LED 110 current would barely reach the first, high threshold $I_{HT}$.

Because the second comparator 135 is not receiving comparable information during $T_{OFF}$, a different approach may be utilized, as an option, for determining an undershoot time interval or duration. Accordingly, by also making the first comparator 130 and second comparator 135 to be similar, such that each effectively having the same rising and falling time intervals as the other (symmetrical), then the undershoot time may be considered to be substantially equal or otherwise comparable to the overshoot time. Assuming such symmetry between comparators 130, 135, results in (Equation 10):

$$T_{undershoot} \approx T_{overshoot},$$

such that the interval from $t_2$ to $t_4$ in turn also would be equal to the undershoot time interval (of $t_5$ to $t_7$). In this instance, the undershoot time is subtracted from $T_{OFF}$ by the controller 125, such that the actual LED 110 current would barely decrease to the second, low threshold $I_{LT}$. In both overshoot and undershoot circumstances, the measurements of these intervals may be completed during the initial system 150 start up, and treated as constants during subsequent switching cycles or, alternatively, the overshoot and undershoot time intervals may be calibrated whenever the corresponding first (peak) comparator 130 has valid information. In addition, because the undershoot and overshoot time periods may be symmetrical, when the gate driver 165 and switch 155 have symmetrical rise and fall times, and when the various comparators have symmetrical rise and fall times, then the measurement of one (overshoot) also may be used for the other (undershoot).

In another variation, when the second comparator 135 does not provide valid information during an on time interval (e.g., the second comparator 135 has already indicated that the low threshold of current has been reached when the blanking time has elapsed), then the relevant undershoot time may be considered to be only the rise time of the gate driver 165 and switch 155 which, given the symmetrical rise and fall times, would be equal to the fall time of the gate driver 165 and switch 155. This may be determined as described below, or as another alternative, the overshoot time (which also includes first comparator 130 rise or fall time) may be utilized as a sufficiently accurate estimation.

In addition, in exemplary embodiments, depending upon selected tolerance levels, the undershoot compensation may be omitted, as lower current levels are not harmful to the LEDs 110, and if the undershoot is not large, may not be visually apparent. Alternatively, the first, high threshold $I_{HT}$ and the second, low threshold $I_{LT}$ may also be adjusted in advance, to provide tighter regulation, such as spacing them apart by 5% of 7.5% intervals, rather than 10% intervals, for example.

Both of the overshoot and undershoot controls, however, generally should be implemented such that both the first (peak) comparator 130 and the second (valley) comparator 135 periodically trip, to avoid the LED 110 current from deviating down or up without notice. Accordingly, in accordance with the exemplary embodiments, the controller 125 will periodically allow the LED 110 current to rise and fall sufficiently to trip the first (peak) comparator 130 and the second (valley) comparator 135, respectively.

Conversely, if the specification for LED 110 current ripple allow current overshoot (e.g., allowing the LED 110 current envelope to follow $V_{IN}$ ripple), then the overshoot and undershoot may be made symmetrical as well, such as by increasing the off time $T_{OFF}$ by the undershoot (or symmetrical overshoot) interval. By doing so, the LED 110 average current would remain constant.

Figure 5:
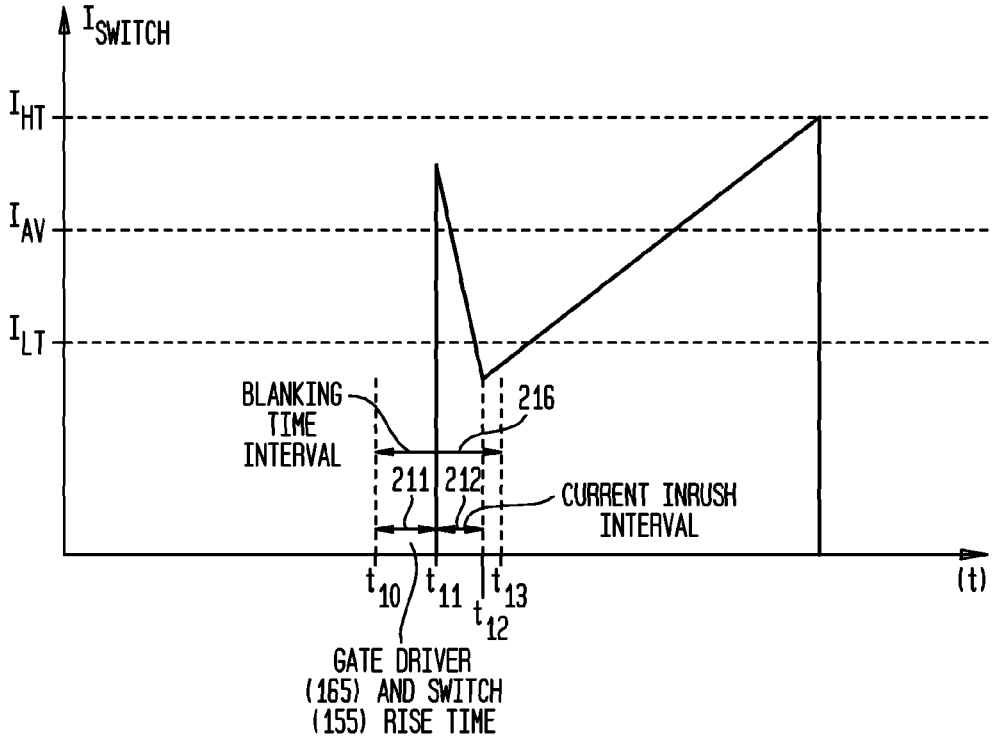
FIG. 5 is a graphical diagram of an inrush current and a blanking time interval in accordance with the teachings of the present invention.

FIG. 5 is a graphical diagram of an inrush current through the switch 155 when it is turned on and a "blanking" time interval in accordance with the teachings of the present invention. In the prior art, such an inrush (transient) current would be filtered using an additional capacitor and resistor (RC filter) in parallel with the current sensor 160; in the exemplary embodiments, the use of such an RC filter is not required, and a blanking time interval is utilized instead, as mentioned above and as described below. Initially the controller 125 issues a command to the gate driver 165 (and thereby switch 155) to turn on, at time $t_{10}$. After the gate driver 165 and switch 155 rise time (interval 211) (combined as "Tp_gate_drive_rise" time), the switch 155 current exhibits a transient spike, referred to as an "inrush", starting at time $t_{11}$, typically caused by its terminal capacitance and the reverse recovery of diode 115, which lasts for interval 212 (through time $t_{12}$). This inrush current through the switch 155 may be higher than the average current ($I_{AV}$) and potentially even higher than the first, high threshold ($I_{HT}$), causing their respective comparators 140, 130 to trip (and provide corresponding logic high signals to the controller 125). In accordance with the exemplary embodiments, the controller 125 disregards this information by establishing or setting a "blanking" time interval (216) ("Tblank"), during which the outputs of the comparators 130, 135, and 140 are ignored. The blanking time interval commences when the controller 125 generates the command to turn on the gate driver 165 (and switch 155) ($t_{10}$), and extends until the transient inrush current has settled ($t_{13}$), resulting in (Equation 10):

$$T_{blank} > T_{P_gate_drive_rise} T_{inrush}.$$

The transient, inrush time interval (212) is generally a function of switch 155 terminal capacitance, diode 115 reverse recovery charge, and the sense resistance value (when current sensor 160 is implemented as a resistor). If the inrush current is higher than the average current ($I_{AV}$), it is possible for the controller 125 to determine the inrush time and adjust the blanking time appropriately.

Ideally, Equation 4 provides that $T_{ON1}$ should be equal to $T_{ON2}$. The controller 125, however, as mentioned above, should turn on the gate driver 165 and switch 155 earlier by an amount equal to their combined rise time (Tp_gate_drive_rise time). In a system where the gate driver 165 is designed such that its rise time is close to the overshoot time (e.g., the gate driver 165 and switch 155 have symmetrical rising and falling times and comparator delay time is not significant), then the overshoot time can be utilized to decrease $T_{OFF}$.

Yet another method of determine the rise time of the gate driver 165 and switch 155 (Tp_gate_drive_rise) is through the third, average current ($I_{AV}$) comparator 140. Although the moment when the switch 155 inrush current trips the third, average current ($I_{AV}$) comparator 140 should not be used as an indicator of the actual inductor 105 average current, it can be used to indicate the time when the switch 155 actually starts to conduct. Accordingly, the rise time of the gate driver 165 and switch 155 and the rise time of the third, average current ($I_{AV}$) comparator 140 ("Tav_comp_rise") (Tp_gate_drive_rise+Tav_comp_rise) can be measured from the time the controller 125 issues the turn on command until the third, average current ($I_{AV}$) comparator 140 trips. Then the third, average current ($I_{AV}$) comparator 140 rise time (Tav_comp_rise) is subtracted from the measurement in order to obtain the rise time of the gate driver 165 and switch 155 (Tp_gate_drive_rise). In an exemplary embodiment, the third, average current ($I_{AV}$) comparator 140 rise time (Tav_comp_rise) is a known design parameter or is significantly smaller than the rise and fall times of the gate driver 165 and switch 155 (Tp_gate_drive_rise and Tp_gate_drive_fall).

The rise times of the various comparators 130, 135 and 140 may also affect the measurements of $T_{ON1}$ and $T_{ON2}$. As mentioned above, $T_{ON1}$ is the interval from the time the current reaches the low threshold current level ($I_{LT}$), as determined by the second ($I_{LT}$) comparator 135 (or from the time when the switch 155 actually conducts) to the time the current reaches the average current level ($I_{AV}$), as determined by the third, average current ($I_{AV}$) comparator 140. $T_{ON2}$ is the time interval from the average current level to the first, high (peak) current level, namely, as determined by the third, average current ($I_{AV}$) comparator 140 and the first ($I_{HT}$) comparator 130, respectively. In the exemplary embodiments, therefore, the first ($I_{HT}$) comparator 130 and the third, average current ($I_{AV}$) comparator 140 are designed or implemented to have the same or substantially similar delay times (i.e., $T_{av_comp_rise} = T_{pk_comp_rise}$). With the rise times of the first ($I_{HT}$) comparator 130 and the third, average current ($I_{AV}$)

comparator 140 being substantially the same, then $T_{ON2}$ can be measured by the interval from when the controller 125 receives the rising edge of the third, average current ($I_{AV}$) comparator 140 to when the controller 125 receives the rising edge of the first ($I_{HT}$) comparator 130. It should be noted, as mentioned above, that this measurement does not apply during the blanking time interval, or when the controller 125 does not receive a valid rising edge of the first ($I_{HT}$) comparator 130 (e.g., due to overshoot compensation, in which case $T_{ON2}$ may be adjusted occasionally in order for the first ($I_{HT}$) comparator 130 to trip and provide information at these various intervals).

As indicated above, $T_{ON1}$ may be measured from the interval beginning with the controller 125 receiving the rising edge of the second ($I_{LT}$) comparator 135 (when available (i.e. when the rising edge did not occur during the blanking interval)) until the controller 125 receives the rising edge of the third, average current ($I_{AV}$) comparator 140, or beginning with the controller 125 generating the turn on command for the gate driver 165 and switch 155) until the controller 125 receives the rising edge of the third, average current ($I_{AV}$) comparator 140 ($T_{ON1}$ measured). For the former case, given the symmetry of the comparators, no additional compensation is needed for determining $T_{ON1}$ measured. In the latter case however, when the rising edge of the second ($I_{LT}$) comparator 135 does not provide valid information (during the blanking interval, or due to undershoot compensation), then for this measurement, the rise time of the gate driver 165 and switch 155 should then be subtracted, to provide the actual value of $T_{ON1}$ ($T_{ON1} \approx T_{ON1}$ measured−Tav_comp_rise). $T_{ON1}$ may also be measured using the transient current spike (inrush current), if the inrush current is sufficiently high to trip the third, average current ($I_{AV}$) comparator 140, indicating a start of the conduction by the switch 155. $T_{ON1}$ is then the interval between the controller 125 receiving the first rising edge of the third, average current ($I_{AV}$) comparator 140 due to the inrush current and receiving the second rising edge of the third, average current ($I_{AV}$) comparator 140 (after the transient has settled). Knowing both $T_{ON1}$ and $T_{ON2}$, the controller 125 may then determine $T_{OFF}$.

In the event that during initial start up, the third, average current ($I_{AV}$) comparator 140 stays high after the transient current spike (inrush current) has settled, indicating that the current is already too high, there is no need to measure $T_{ON1}$ and $T_{ON2}$. Rather, TOFF is extended, to allow current to decrease, with valid measurements for $T_{ON1}$ and $T_{ON2}$ obtainable in the next cycle.

Figure 6:
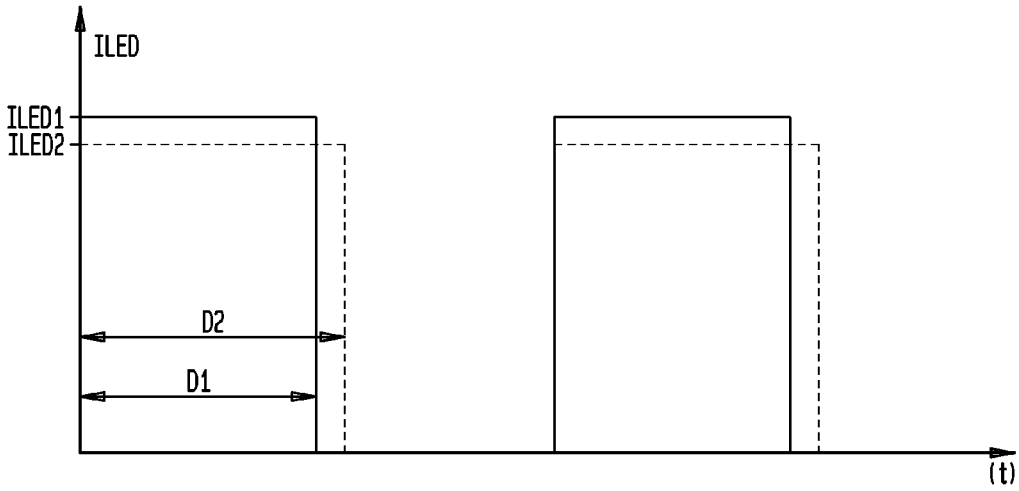
FIG. 6 is a graphical diagram illustrating combined pulse width modulation ("PWM") and amplitude modulation for brightness adjustment in accordance with the teachings of the invention.

FIG. 6 is a graphical diagram illustrating combined pulse width modulation ("PWM") and amplitude modulation for brightness adjustment in accordance with the teachings of the invention. The exemplary embodiments implement brightness control (dimming) using a combination of at least two different electrical biasing techniques across the LEDs 110, such as PWM and amplitude modulation (or constant current regulation ("CCR"). A first electrical biasing technique, by itself, will tend to produce a first wavelength shift (higher or lower) in response to a change in intensity, such as in response to a change in duty cycle for PWM, while a second electrical biasing technique, by itself, will tend to produce a second, opposite or opposing wavelength shift (lower or higher, respectively) in response to the change in intensity, such as in response to a change in amplitude for analog regulation or CCR. In accordance with the exemplary embodiments, any resulting wavelength shift is minimized or maintained within a selected tolerance level by utilizing at least two different and opposing electrical biasing techniques (such that the opposing wavelength shifts effectively "cancel" each other). Additional discussion of that methodology is in one or more related patent applications. To decrease brightness, for PWM, the duty cycle is decreased (e.g., from D1 to D2), and for amplitude modulation (CCR), the amplitude of the LED current is decreased (e.g., from ILED1 to ILED2), as illustrated in FIG. 6. In accordance with the exemplary embodiments, the controller 125 implements dimming by using both PWM and amplitude modulation, either alternating them in successive modulation intervals or combining them during the same modulation interval, with the latter illustrated in FIG. 6. This inventive combination of at least two different electrical biasing techniques having opposing effects on wavelength emission allows for both regulating the intensity of the emitted light while controlling the wavelength emission shift, from either or both the LED response to intensity variation (dimming technique) and due to p-n junction temperatures changes, and also to produce dynamic lighting and color effects.

Figure 7:
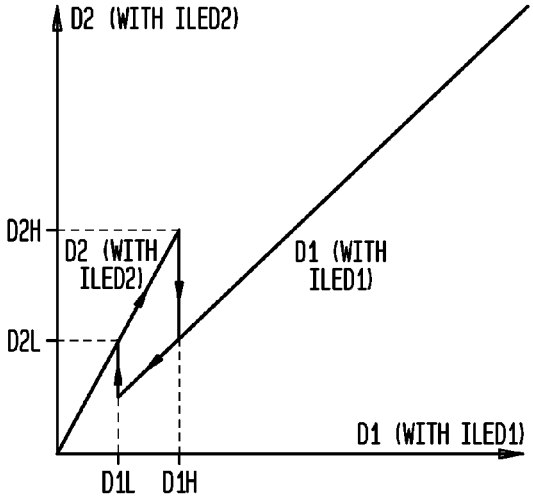
FIG. 7 is a graphical diagram illustrating hysteresis between two amplitude levels and duty cycle ratios for brightness adjustment in accordance with the teachings of the invention.

FIG. 7 is a graphical diagram illustrating hysteresis between two amplitude levels (ILED1, ILED2) and duty cycle ratios (D1L, D2L, D1H, D2H) for brightness adjustment in accordance with the teachings of the invention. In order to prevent jitter, a hysteresis is implemented as illustrated in FIG. 7. The operating points (ILED1, D1L) have the same brightness (color) to (ILED2, D2L), and the same brightness applies to (ILED1, D1H) and (ILED2, D2H). When D1 comes from high brightness down to D1L, ILED1 is changed to ILED2 and D2L is used instead. When D2 comes up from low brightness to D2H, ILED2 is switched to ILED1 and D1H is used.

Figure 8:
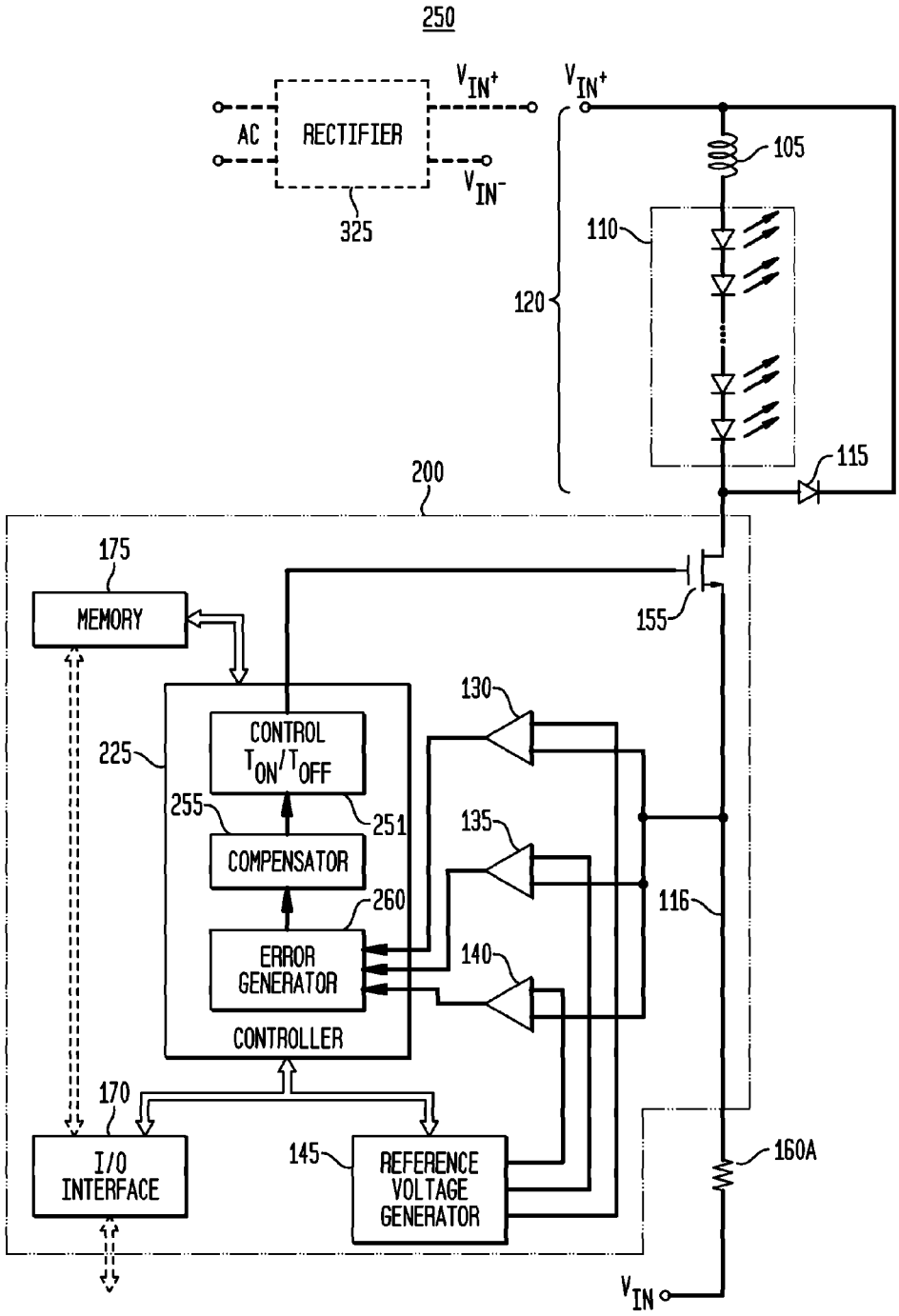
FIG. 8 is a block and circuit diagram of an exemplary second system embodiment and second apparatus embodiment in accordance with the teachings of the present invention.

FIG. 8 is a block and circuit diagram of an exemplary second system 250 embodiment and second apparatus 200 embodiment, for fixed frequency switching operation, in accordance with the teachings of the present invention. The second system 250 and second apparatus 200 differ from the first system 150 and first apparatus 100 insofar as: (1) the combined duration (arithmetic sum) of the on ($T_{ON}$) and off ($T_{OFF}$) times for the LEDs 110 is constant, not variable, such that the second system 250 has a fixed or constant switching frequency (rather than the variable switching frequency previously discussed); and (2) the controller 225 is adapted to provide current control when the commencement or initiation of the on time of the switch 155 is at a fixed, regular frequency. In addition, as an illustrated alternative, the controller 225 is coupled directly to the switch 155, rather than via a gate driver (165). It should be understood, however, that the second system 250 and second apparatus 200 may also include such a gate driver circuit 165, such as a buffer.

For the second system 250 and second apparatus 200, the controller 225 includes an error generator 260, a compensator 255, and a control block 251 for determining the respective on ($T_{ON}$) and off ($T_{OFF}$) durations for the switch 155. In this embodiment, the controller 225 also provides that $T_{ON1}$ is substantially equal to $T_{ON2}$, with the error generator 260 generating an error signal substantially equal or proportional to the difference between $_{TON1}$ and $_{TON2}$ (error=$T_{ON2}-T_{ON1}$, error≈$T_{ON2}-T_{ONI}$, or error≈c·($T_{ON2}-T_{ON1}$), where "c" is a constant of proportionality). The error signal is provided to the compensator 255, which then adjusts the on time ($T_{ON}$) of the switch 155, which is then correspondingly switched on and off by the control block 251. It should be noted, because the switch 155 is switched on at a fixed frequency, adjusting the on time ($T_{ON}$) of the switch 155 automatically changes the off time ($T_{OFF}$) of the switch 155 (e.g., increasing the on time $T_{ON}$ decreases the off time $T_{OFF}$, and vice versa).

Figure 9:
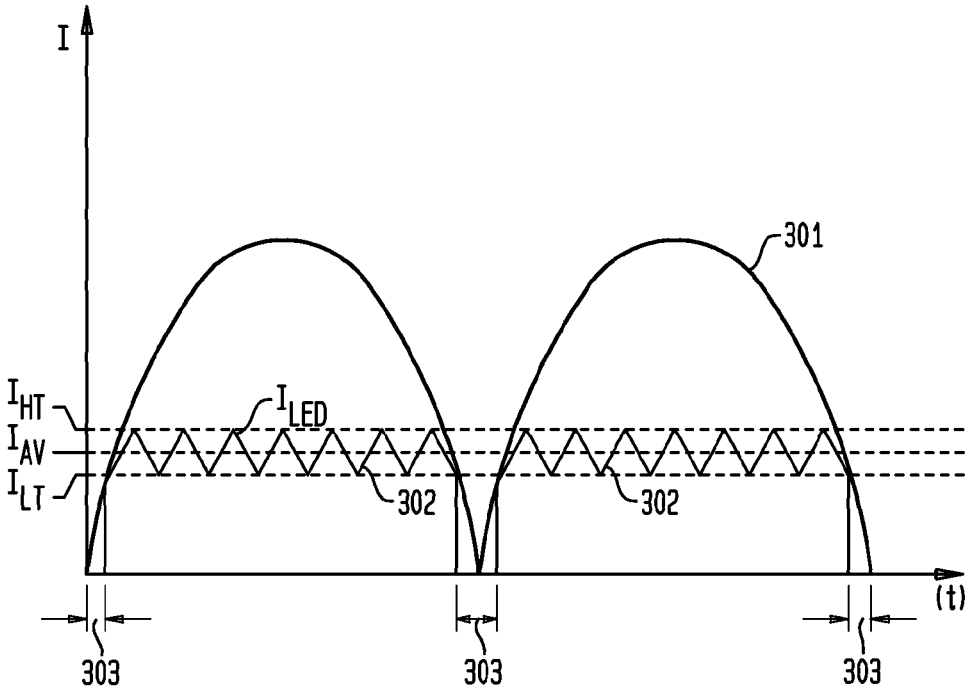
FIG. 9 is a graphical diagrams illustrating a second exemplary current waveform through the solid state lighting and a rectified AC current in accordance with the teachings of the present invention.

FIG. 9 is a graphical diagrams illustrating a second exemplary current waveform through the solid state lighting and a rectified AC current in accordance with the teachings of the present invention. Such a rectified AC current 301 (or voltage) may be provided by a rectifier 325 to provide a voltage input $V_{IN}$ (illustrated as $V_{IN}^+$ and $V_{IN}^-$) having a DC average value, from an AC line voltage (AC mains), for example, and may be utilized with either the first or second system 150, 250 and first or second apparatus 100, 200, and also may be utilized with the third system 350 discussed below. When the rectified AC current 301 is below a selected (or predetermined) threshold, illustrated as intervals 303, there is generally no switch 155 current, and the apparatus 100, 200 will typically be off during these AC zero crossing intervals. As illustrated, the switch 155 is turned on, above the selected (or predetermined) threshold, the LED 110 current 302 will initially track the rectified AC current 301, increasing to the second, low threshold ($I_{LT}$), reaching the average current level ($I_{AV}$) and then the first, high threshold ($I_{HT}$), followed by turning the switch 155 off for its calculated duration, and followed by successive on and off cycles, as described above, using the measurements and calculations described above for $T_{ON1}$, $T_{ON2}$, and $T_{OFF}$, or using the error signal (e.g., error $\approx T_{ON2}-T_{ON1}$) described above, for either variable or fixed frequency embodiments. Such an apparatus and system can be built directly into an Edison socket, and further, can provide power factor correction ("PFC"). In order to achieve PFC operation, the controller 125 or compensator 255 is comparatively slow with respect to a $V_{IN}$ ripple frequency of 120 Hz (or 100 Hz). For example and without limitation, for each half of the AC cycle, the $T_{ON}$ determined and outputted by the compensator 255 can be regarded as a constant, and is adjusted during successive half-cycles.

It should be noted that the first system 150, first apparatus 100, the second system 250 and second apparatus 200, and their versions including an AC rectifier 325, may be scaled or extended to multiple channels of LEDs 110. In one such implementation, the first or second apparatus 100, 200 is instantiated in its entirety for each separate channel of LEDs 110.

In another such implementation, discussed below with reference to FIG. 10, the comparators 130, 135, 140 are instantiated separately for each separate or independent channel of LEDs 110, such that the LED 110 current through each channel is separately monitored. In this scaled embodiment, the controller 125, 225 then has multiple outputs, one to each to each gate driver 165 (which in turn is coupled to a corresponding switch 155 for each separate or independent channel of LEDs 110). The controller 125, 225 separately computes the various on ($T_{ON1}$ and $T_{ON2}$) durations for the switch 155, and for apparatus 100, the controller 125 also computes the off ($T_{OFF}$) duration, for each separate (or independent) channel of LEDs 110, and separately controls each gate driver 165 to each switch 155 for each separate channel of LEDs 110 to provide the current regulation through each such channel of LEDs 110 as discussed above and as discussed below.

Figure 10:
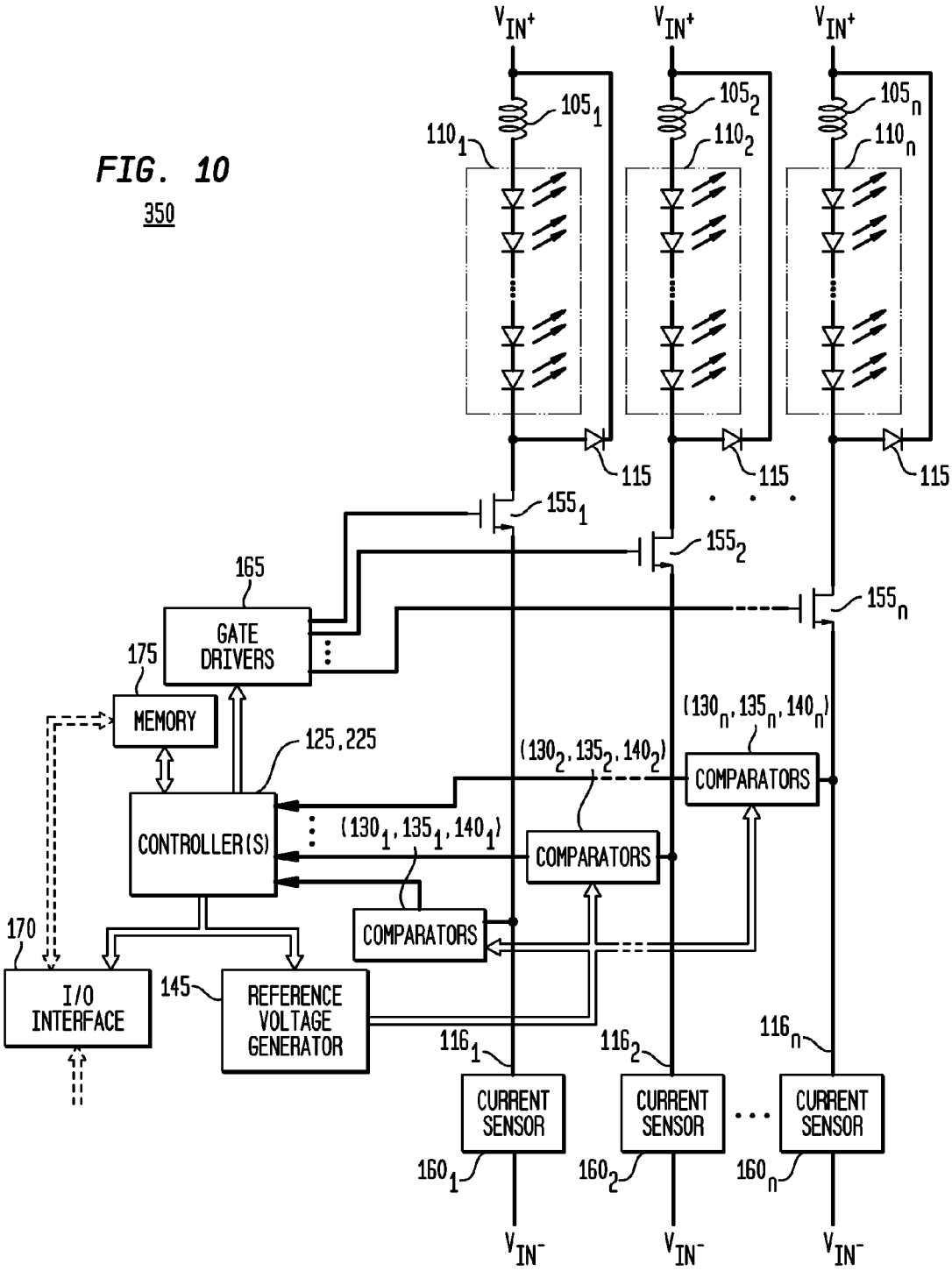
FIG. 10 is a block and circuit diagram of an exemplary third system embodiment in accordance with the teachings of the present invention.

FIG. 10 is a block and circuit diagram of an exemplary third system 350 embodiment, for multichannel operation, in accordance with the teachings of the present invention. As mentioned above, the various first and second apparatus 100, 200 may be extended to control current through a plurality of separate arrays 310 (also referred to equivalently as channels or strings) of LEDs 110, illustrated as array $\mathbf{310}_1$ having LEDs $\mathbf{110}_1$, array $\mathbf{310}_2$ having LEDs $\mathbf{110}_2$, through array $\mathbf{310}_n$ having LEDs $\mathbf{110}_n$. Each such array or channel 310 includes at least one LED 110 or a plurality of LEDs 110 connected in series. In contrast with the prior art, the plurality of LEDs 110 of each array are not required to be identical or from the same manufacturing bin; instead, because of the separate control and regulation provided by the exemplary embodiments, there may be significant variation among the LEDs 110, for a considerable cost savings.

With the separate current control for each LED array 310, the regulated current can be matched to each separate LED array 310. Accordingly, various LED arrays 310 are not subject to excessive current levels, that would be caused in the prior art systems from some LED arrays having a higher impedance and drawing less current than expected. As a consequence, the exemplary third system 350 enables increased durability, improved system lifetime, decreased heat generated (also enabling a corresponding decrease in the size of heat sinks for the LEDs 110), a decrease in the number of LEDs 110 required for the same optical output, and overall increased system efficiency and efficacy.

As illustrated for the third system 350, each array 310 has a corresponding switch 155, illustrated as switch $\mathbf{155}_1$, switch $\mathbf{155}_2$, through switch $\mathbf{155}_n$, which are controlled by respective gate driver circuits (buffers) 165 (illustrated collectively, for ease of discussion), under the control of at least one controller 125, 225. The comparators 130, 135, 140 are instantiated separately for each separate or independent array or channel 310 of LEDs 110, such that the LED 110 current through each array (channel) 310 (via corresponding current sensors $\mathbf{160}_1$, $\mathbf{160}_2$, through $\mathbf{160}_n$) is separately monitored and separately controlled, as described above for the first and second systems 100, 200. At least one reference voltage generator 145 provides the corresponding reference voltages (corresponding to the first (high) threshold, average, and second (low) threshold) for each current through each separate array 310. It should be noted that the various average, first and second threshold currents may be either the same or different across the various arrays 310, such that any selected array 310 may have its own set average and threshold current levels, separate from the average and threshold currents of the other arrays 310.

In this scaled, third system 350 embodiment, the controller 125, 225 then has multiple outputs, one to each to each gate driver 165, to turn on or off a corresponding switch 155 for each separate array 310 of LEDs 110. The controller 125, 225 separately determines the various on ($T_{ON1}$ and $T_{ON2}$) durations for each corresponding switch $\mathbf{155}_1$, switch $\mathbf{155}_2$, through switch $\mathbf{155}_n$, and for variable frequency operation, the controller 125 also computes the off ($T_{OFF}$) duration, for each separate (or independent) array 310 of LEDs 110. The controller 125, 225 separately controls each gate driver 165 to each switch $\mathbf{155}_1$, switch $\mathbf{155}_2$, through switch $\mathbf{155}_n$, for each separate array 310 of LEDs 110, to provide separate current regulation through each separate channel of LEDs 110 in accordance with the exemplary embodiments of the invention.

Accordingly, for each separate array 310 of LEDs 110, for variable frequency switching, the controller 125 will determine $T_{ON1}$ and $T_{ON2}$, and a corresponding $T_{OFF}$, as previously described above for the first system 150 and first apparatus 100, to provide regulated current control, for each array 310, and for fixed frequency switching, the controller 225 will determine $T_{ON1}$ and $T_{ON2}$, as previously described above for the second system 250 and second apparatus 200, to provide regulated current control, for each array 310.

While the exemplary third system 350 provides separate control to each LED array 310, such control may be independent, controlling each LED array 310 completely independently of all the other LED arrays 310, or such control may include any type of coordinated, joint or dependent regulation, for any selected lighting or color effect, as may be necessary or desirable for any selected application. In addition, such independent or dependent regulation may be implemented for any type of LEDs 110, such as separate or independent control of red, blue, and green LEDs 110, or coordinated control of such red, blue, and green LEDs 110, such as to produce various lighting effects having a selected hue, for example. Also for example, lighting effects such as output intensity, color output, color temperature, etc. may be regulated independently or in a coordinated manner for each LED array 310. Importantly, the exemplary third system 350 is capable of providing completely separate and independent current regulation of each LED array 310, with any such independence selectively implemented or not, for example, by the end user of the exemplary third system 350. Also importantly, the exemplary third system 350 is capable of providing any type of coordinated current regulation of each LED array 310, with any such coordination selectively implemented or not, for example, by the end user of the exemplary third system 350.

Figure 11:
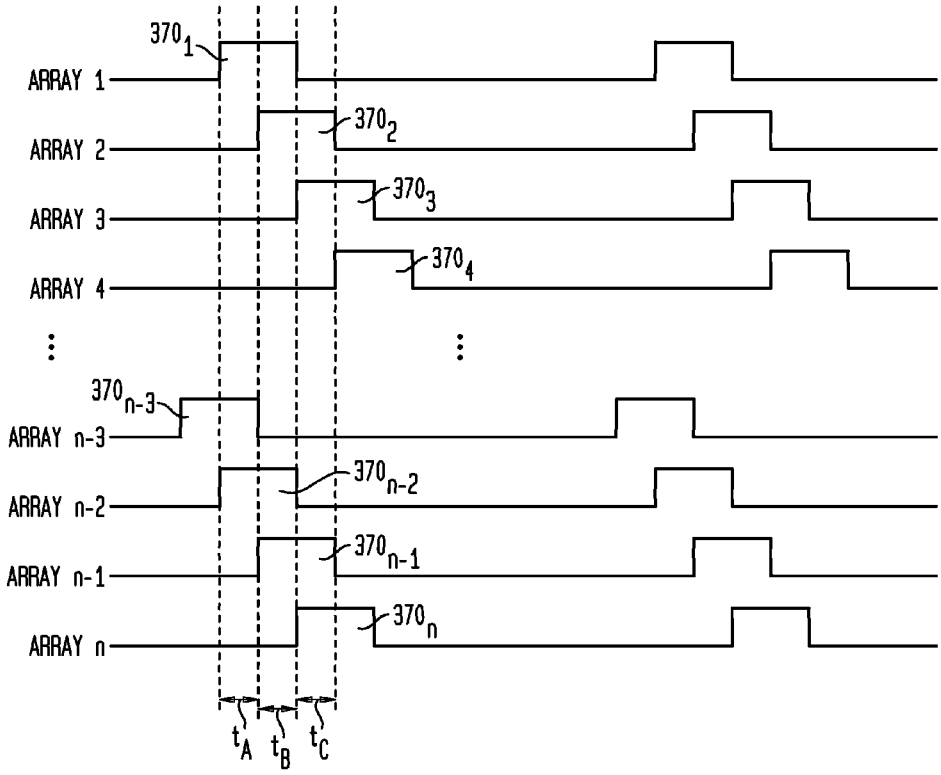
FIG. 11 is a timing diagram illustrating exemplary multiphase switching of the exemplary third system embodiment in accordance with the teachings of the present invention.

As an example of one form of coordinated control, in the exemplary third system 350, interleaving of switch 155 on ($T_{ON}$) durations may be implemented, providing a multiphase control, such that only selected arrays 310 are switched on and are conducting current during a given time interval. FIG. 11 is a timing diagram illustrating exemplary multiphase switching of the exemplary third system embodiment, for "n" arrays 310 of LEDs 110, in accordance with the teachings of the present invention. As illustrated, each $T_{ON}$ "pulse" 370 represents the on duration ($T_{ON}$) of a switch 155 of an array 310; while illustrated as a square wave, it may have any waveform, and merely represents a signal from the controller 125, 225 to turn on (and keep on for the selected on time duration) the corresponding switch 155 (via a corresponding gate driver 165). Also as illustrated, the timing of each such $T_{ON}$ pulse 370 differs across the "n" arrays, with $T_{ON}$ pulses $\mathbf{370}_1$, $\mathbf{370}_{n-3}$, and $\mathbf{370}_{n-2}$ occurring during time interval $t_A$ for LED arrays $\mathbf{310}_1$, $\mathbf{310}_{n-3}$, and $\mathbf{310}_{n-2}$, respectively; $T_{ON}$ pulses $\mathbf{370}_1$, $\mathbf{370}_2$, $\mathbf{370}_{n-2}$ and $\mathbf{370}_{n-1}$ occurring during time interval $t_B$ for LED arrays $\mathbf{310}_1$, $\mathbf{310}_2$, $\mathbf{310}_{n-2}$ and $\mathbf{310}_{n-1}$, respectively; $T_{ON}$ pulses $\mathbf{370}_2$, $\mathbf{370}_3$, $\mathbf{370}_{n-1}$ and $\mathbf{370}_n$ occurring during time interval $t_C$ for LED arrays $\mathbf{310}_2$, $\mathbf{310}_3$, $\mathbf{310}_{n-1}$ and $\mathbf{310}_n$, respectively; and so on. The various on durations may be selected to be separate (e.g., $T_{ON}$ pulses $\mathbf{370}_1$ and $\mathbf{370}_4$) or to overlap (e.g., $T_{ON}$ pulses $\mathbf{370}_1$ and $\mathbf{370}_2$), as may be necessary or desirable.

Because of this interleaving, multiphase control, not all LED arrays 310 are receiving current at the same time. This enables a much smoother AC input current, which minimizes any requirement on input electromagnetic interference (EMI) filter size, further enabling a reduction in the input filter capacitor size, and reduced component costs. It is also expected to work well with a thyristor-type dimming.

It should be noted that the controllers 125, 225 may be implemented the same, and configured or otherwise programmed for operation as part of any of the systems 150, 250, and 350.

Figure 12:
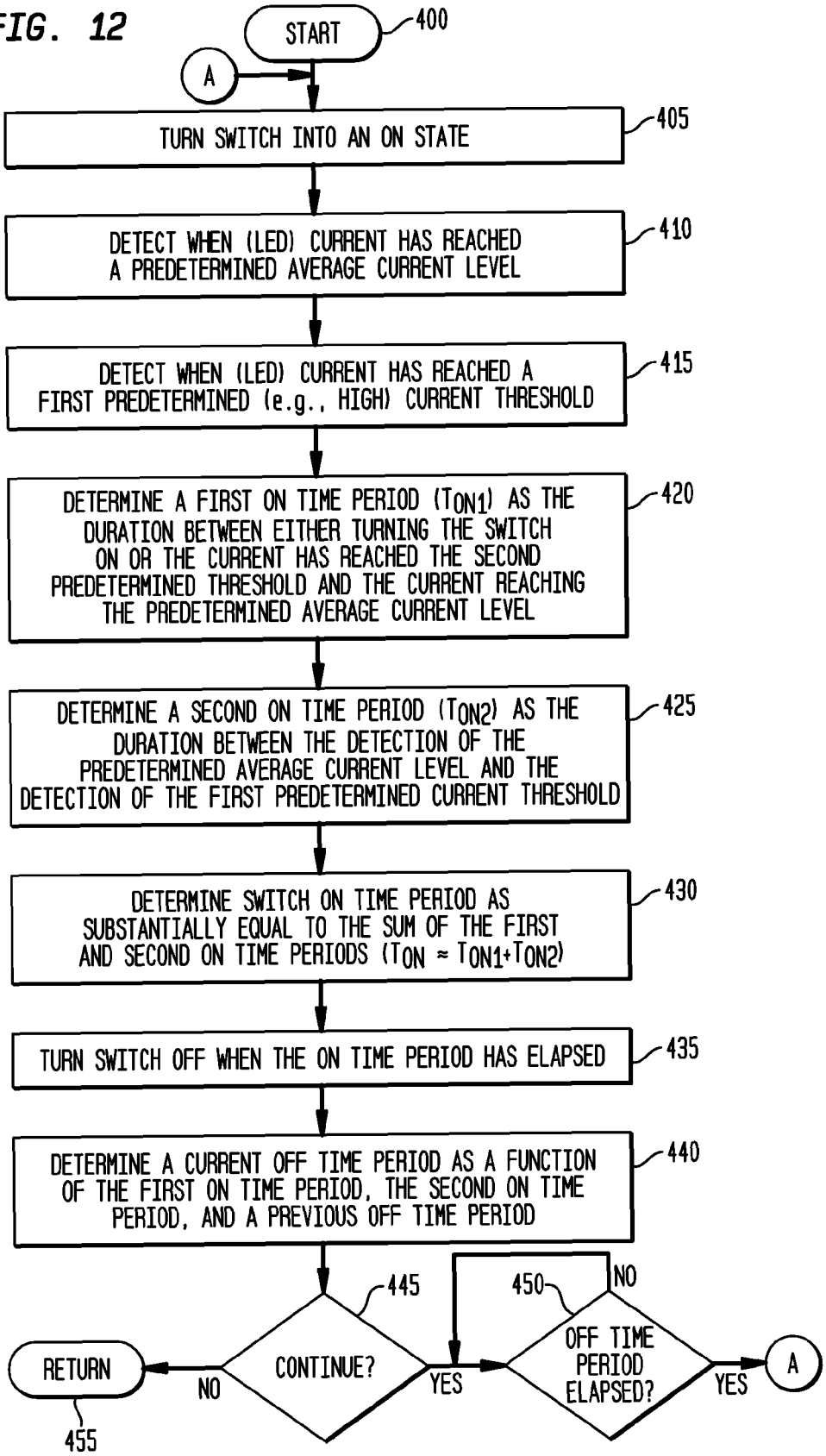
FIG. 12 is a flow diagram of an exemplary method embodiment in accordance with the teachings of the present invention.

FIG. 12 is a flow diagram of an exemplary method embodiment, in accordance with the teachings of the present invention, for controlling the energizing of solid state lighting, such as LEDs 110, and provides a useful summary. As discussed above, the solid state lighting is coupled to a switch (155) providing an electrical current path (e.g., through current sensor 160), and with the solid state lighting having an electrical current. The method begins, start step 400, with turning the switch 155 into an on state, step 405. The method then detects when the electrical current has reached a predetermined average current level, step 410, and detects when the electrical current has reached a first predetermined (e.g., high) current threshold, step 415. When available (i.e., not during the blanking interval), and prior to detecting the average current level, step 410 may also include detecting when the electrical current has reached a second predetermined (e.g., low) current threshold. The method then determines a first on time period ($T_{ON1}$) as a duration between the detection of the second predetermined (e.g., low) current threshold (or turning the switch into the on state) and the detection of the predetermined average current level, step 420, and determines a second on time period ($T_{ON2}$) as a duration between the detection of the predetermined average current level and the detection of the first predetermined current threshold, step 425. An on time period ($T_{ON}$) of the switch is then determined as substantially equal or proportional to the sum of the first on time period and the second on time period ($T_{ON} \approx T_{ON1} + T_{ON2}$), step 430. When the on time period has elapsed, the switch is turned off, step 435. For a first embodiment, the exemplary method also determines a current off time period of the switch as a function of the first on time period, the second on time period, and a previous off time period (Equations 7 and 8), step 440. When the method continues, step 445, then following expiration of the off time period, step 450, the method returns to step 405 to turn the switch on, and the method iterates. When the method does not continue in step 445, the method may end, return step 455.

Not separately illustrated, the method may also include: adjusting the current off time period to provide that the first on time period is substantially equal to the second on time period (($T_{ON1} \approx T_{ON2}$); or decreasing the current off time period proportionally to a driving gate rising edge time period. In addition, the determination of the current off time period of the switch may be a further function, more specifically, of previous first and second on times and one or more current first on times.

The exemplary method may also provide for determining a blanking time interval following turning the switch into the on state, and ignoring the detection of the second predetermined current threshold, the detection of the predetermined average current level or the detection of the first predetermined current threshold during the blanking time interval. The blanking time interval may be determined as proportional to a gate rising edge time period and a transient current time period, or as proportional to a gate rising edge time period and detection of the predetermined average current level.

The exemplary method may also provide for adjusting a brightness level of the solid state lighting by using at least two electrical biasing techniques, and for example, adjusting a brightness level of the solid state lighting by using a hysteresis of at least two electrical current amplitude levels and at least two electrical current duty cycle ratios.

The method may also provide for current overshoot protection, by adjusting the second on time period proportionally to a driving gate falling edge time period, and more particularly, such as by decreasing the second on time period proportionally to a driving gate falling edge time period and a comparator falling edge time period.

The method may also provide for current undershoot protection by adjusting the first on time period proportionally to a driving gate rising edge time period, such as by increasing the first on time period proportionally to a driving gate rising edge time period. Such undershoot protection may be provided equivalently by decreasing the current off time period proportionally to a driving gate rising edge time period, such as by decreasing the current off time period proportionally to a driving gate rising edge time period.

In another exemplary embodiment, the method may include generating an error signal as a difference between the second on time period and the first on time period, and then adjusting the on time period proportionally to the error signal.

Referring to FIGS. 1, 8 and 10, as mentioned above, the I/O interface 170 is utilized for input/output communication, providing appropriate connection to a relevant channel, network or bus; for example, and the interface 170 may provide additional functionality, such as impedance matching, drivers and other functions for a wireline interface, may provide demodulation and analog to digital conversion for a wireless interface, and may provide a physical interface for the memory 175 and controller 125, 225 with other devices. In general, the interface 170 is used to receive and transmit data, depending upon the selected embodiment, such as to receive intensity level selection data, temperature data, and to provide or transmit control signals for current regulation (for controlling an LED driver), and other pertinent information. For example and without limitation, the interface 170 may implement communication protocols such as DMX 512, DALI, $I^2C$, SPI, etc.

Also as mentioned above, a controller 125, 225 (or, equivalently, a "processor") may be any type of controller or processor, and may be embodied as one or more controllers 125, 225, adapted to perform the functionality discussed herein. As the term controller or processor is used herein, a controller 125, 225 may include use of a single integrated circuit ("IC"), or may include use of a plurality of integrated circuits or other components connected, arranged or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components. As a consequence, as used herein, the term controller (or processor) should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SDRAM, SRAM, MRAM, ROM, FLASH, EPROM or $E^2$PROM. A controller (or processor) (such as controller 125, 225), with its associated memory, may be adapted or configured (via programming, FPGA interconnection, or hard-wiring) to perform the methodology of the invention, as discussed above and below. For example, the methodology may be programmed and stored, in a controller 125, 225 with its associated memory (and/or memory 175) and other equivalent components, as a set of program instructions or other code (or equivalent configuration or other program) for subsequent execution when the processor is operative (i.e., powered on and functioning). Equivalently, when the controller 125, 225 may implemented in whole or part as FPGAs, custom ICs and/or ASICs, the FPGAs, custom ICs or ASICs also may be designed, configured and/or hard-wired to implement the methodology of the invention. For example, the controller 125, 225 may be implemented as an arrangement of controllers, microprocessors, DSPs and/or ASICs, collectively referred to as a "controller", which are respectively programmed, designed, adapted or configured to implement the methodology of the invention, in conjunction with a memory 175.

The memory 175, which may include a data repository (or database), may be embodied in any number of forms, including within any computer or other machine-readable data storage medium, memory device or other storage or communication device for storage or communication of information, currently known or which becomes available in the future, including, but not limited to, a memory integrated circuit ("IC"), or memory portion of an integrated circuit (such as the resident memory within a controller 125, 225 or processor IC), whether volatile or non-volatile, whether removable or non-removable, including without limitation RAM, FLASH, DRAM, SDRAM, SRAM, MRAM, FeRAM, ROM, EPROM or $E^2$PROM, or any other form of memory device, such as a magnetic hard drive, an optical drive, a magnetic disk or tape drive, a hard disk drive, other machine-readable storage or memory media such as a floppy disk, a CDROM, a CD-RW, digital versatile disk (DVD) or other optical memory, or any other type of memory, storage medium, or data storage apparatus or circuit, which is known or which becomes known, depending upon the selected embodiment. In addition, such computer readable media includes any form of communication media which embodies computer readable instructions, data structures, program modules or other data in a data signal or modulated signal, such as an electromagnetic or optical carrier wave or other transport mechanism, including any information delivery media, which may encode data or other information in a signal, wired or wirelessly, including electromagnetic, optical, acoustic, RF or infrared signals, and so on. The memory 175 may be adapted to store various look up tables, parameters, coefficients, other information and data, programs or instructions (of the software of the present invention), and other types of tables such as database tables.

As indicated above, the controller 125, 225 is programmed, using software and data structures of the invention, for example, to perform the methodology of the present invention. As a consequence, the system and method of the present invention may be embodied as software which provides such programming or other instructions, such as a set of instructions and/or metadata embodied within a computer readable medium, discussed above. In addition, metadata may also be utilized to define the various data structures of a look up table or a database. Such software may be in the form of source or object code, by way of example and without limitation. Source code further may be compiled into some form of instructions or object code (including assembly language instructions or configuration information). The software, source code or metadata of the present invention may be embodied as any type of code, such as C, C++, SystemC, LISA, XML, Java, Brew, SQL and its variations (e.g., SQL 99 or proprietary versions of SQL), DB2, Oracle, or any other type of programming language which performs the functionality discussed herein, including various hardware definition or hardware modeling languages (e.g., Verilog, VHDL, RTL) and resulting database files (e.g., GDSII). As a consequence, a "construct", "program construct", "software construct" or "software", as used equivalently herein, means and refers to any programming language, of any kind, with any syntax or signatures, which provides or can be interpreted to provide the associated functionality or methodology specified (when instantiated or loaded into a processor or computer and executed, including the controller 125, 225, for example).

The software, metadata, or other source code of the present invention and any resulting bit file (object code, database, or look up table) may be embodied within any tangible storage medium, such as any of the computer or other machine-readable data storage media, as computer-readable instructions, data structures, program modules or other data, such as discussed above with respect to the memory 175, e.g., a floppy disk, a CDROM, a CD-RW, a DVD, a magnetic hard drive, an optical drive, or any other type of data storage apparatus or medium, as mentioned above.

Numerous advantages of the present invention for providing power to solid state lighting, such as light emitting diodes, are readily apparent. The exemplary embodiments allow for energizing one or more LEDs, using digital control and low side sensing, enabling low voltage IC implementations. The exemplary apparatus and system embodiments may be implemented with either fixed or variable frequency switching, and may be implemented with either AC or DC power sources. As a digital implementation, the exemplary embodiments may also be implemented at a reduced cost. The exemplary embodiments also provide for precise current control, within any selected tolerance levels. In addition, the exemplary embodiments also eliminate the required RC filtering of the prior art.

For changes in brightness levels, a combination of forward biasing techniques are implemented, which allow for both regulating the intensity of the emitted light while controlling the wavelength emission shift, from either or both the LED response to intensity variation (dimming technique) and due to p-n junction temperatures changes. In addition, the exemplary embodiments of the invention also provide for varying intensity while simultaneously reducing the EMI produced by prior art lighting systems, especially because current steps in the pulse modulation are dramatically reduced or eliminated completely. The exemplary LED controllers are also backwards-compatible with legacy LED control systems, frees the legacy host computer for other tasks, and allows such host computers to be utilized for other types of system regulation. The exemplary current regulator embodiments provide digital control, without requiring external compensation. The exemplary current regulator embodiments also utilize comparatively fewer components, providing reduced cost and size, while simultaneously providing increased efficiency and enabling longer battery life when used in portable devices.

Although the invention has been described with respect to specific embodiments thereof, these embodiments are merely illustrative and not restrictive of the invention. In the description herein, numerous specific details are provided, such as examples of electronic components, electronic and structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

As used herein for purposes of the present invention, the term "LED" and its plural form "LEDs" should be understood to include any electroluminescent diode or other type of carrier injection- or junction-based system which is capable of generating radiation in response to an electrical signal, including without limitation, various semiconductor- or carbon-based structures which emit light in response to a current or voltage, light emitting polymers, organic LEDs, and so on, including within the visible spectrum, or other spectra such as ultraviolet or infrared, of any bandwidth, or of any color or color temperature.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. A method of controlling solid state lighting, the solid state lighting coupled to a switch providing an electrical current path, and the solid state lighting having an electrical current, the method comprising:

turning the switch into an on state;

detecting when the electrical current has reached a predetermined average current level;

detecting when the electrical current has reached a first predetermined current threshold;

determining a first on time period as a duration between detection of a second predetermined current level or turning the switch into the on state and the detection of the predetermined average current level;

determining a second on time period as a duration between the detection of the predetermined average current level and the detection of the first predetermined current threshold; and determining an on time period of the switch as substantially proportional to a sum of the first on time period and the second on time period.

2. The method of claim 1, further comprising:

when the on time period has elapsed, turning the switch into an off state.

3. The method of claim 2, further comprising:

subsequent to turning the switch into the off state, when a fixed time period has elapsed from having turned the switch into the on state, again turning the switch into the on state and repeating the detection and determination steps.

4. The method of claim 3, further comprising:

generating an error signal as a difference between the second on time period and the first on time period.

5. The method of claim 4, further comprising:

adjusting the on time period proportionally to the error signal.

6. The method of claim 2, further comprising:

when a current off time period has elapsed, turning the switch into the on state and repeating the detection and determination steps.

7. The method of claim 6, further comprising:

determining the current off time period of the switch as a function of the first on time period and the second on time period.

8. The method of claim 6, further comprising:

determining the current off time period of the switch as a function of the first on time period, the second on time period, and a previous off time period.

9. The method of claim 6, further comprising:

determining the current off time period of the switch as:

$$T_{OFF}(K+1) \approx \frac{2 \cdot T_{ON2}(K) \cdot T_{OFF}(K)}{T_{ON1}(K+1) + T_{ON2}(K)},$$

in which $T_{OFF}(K+1)$ is the current off time period, $T_{ON2}(K)$ is a previous second on time period, $T_{OFF}(K)$ is a previous off time period, and $T_{ON1}(K+1)$ is a current first on time period.

10. The method of claim 6, further comprising:

determining the current off time period of the switch as:

$$T_{OFF}(K+1) \approx \frac{(T_{ON1}(K)_A + T_{ON2}(K)) \cdot T_{OFF}(K)}{T_{ON1}(K+1) + T_{ON2}(K)},$$

in which $T_{OFF}(K+1)$ is the current off time period, $T_{ON1}(K)_A$ is a previous first on time period determined using the detection of the second predetermined current level, $T_{ON2}(K)$ is a previous second on time period, $T_{OFF}(K)$ is a previous off time period, and $T_{ON1}(K+1)$ is a current first on time period.

11. The method of claim 6, further comprising:

determining the current off time period of the switch as a function of a current first on time period, a previous second on time period, and a previous off time period.

12. The method of claim 6, further comprising:

determining the current off time period of the switch as a function of a current first on time period, a previous first on time period, a previous second on time period, and a previous off time period.

13. The method of claim 6, further comprising:

adjusting the current off time period to provide that the first on time period is substantially equal to the second on time period.

14. The method of claim 6, further comprising:

decreasing the current off time period proportionally to a driving gate rising edge time period.

15. The method of claim 1, further comprising:

decreasing the on time period proportionally to a driving gate falling edge time period and a comparator falling edge time period.

16. The method of claim 1, further comprising:

determining a blanking time interval following turning the switch into the on state.

17. The method of claim 16, further comprising:

ignoring the detection of the second predetermined current threshold, the detection of the predetermined average current level, or the detection of the first predetermined current threshold during the blanking time interval.

18. The method of claim 16, further comprising:

determining the blanking time interval as proportional to a gate rising edge time period and a transient current time period.

19. The method of claim 16, further comprising:

determining the blanking time interval as proportional to a gate rising edge time period and detection of the predetermined average current level.

20. The method of claim 1, further comprising:

adjusting a brightness level of the solid state lighting by using at least two different and opposing electrical biasing techniques.

21. The method of claim 1, further comprising:

adjusting a brightness level of the solid state lighting by using a hysteresis of at least two electrical current amplitude levels and at least two electrical current duty cycle ratios.

22. The method of claim 1, further comprising:

adjusting the second on time period proportionally to a driving gate falling edge time period.

23. The method of claim 1, further comprising:

decreasing the second on time period proportionally to a driving gate falling edge time period and a comparator falling edge time period.

24. The method of claim 1, further comprising:

detecting when the electrical current has reached the second predetermined current threshold.

25. The method of claim 1, wherein the solid state lighting comprises at least one light emitting diode.

26. The method of claim 25, wherein the at least one light emitting diode is coupled to a power converter, and wherein the electrical current detections occur at a comparatively low side of the power converter.

27. The method of claim 1, wherein the solid state lighting comprises a plurality of arrays of a plurality of series-connected light emitting diodes, and each array of the plurality of arrays further coupled to a corresponding switch providing an electrical current path.

28. The method of claim 27, further comprising:

separately determining a corresponding first on time period, a corresponding second on time period, and a corresponding on time period as substantially proportional to the sum of the corresponding first on time period and the corresponding second on time period for each array of the plurality of arrays.

29. The method of claim 28, further comprising:

when the corresponding on time period has elapsed, separately turning the corresponding switch into the off state.

30. The method of claim 29, further comprising:

separately determining a corresponding off time period for each array of the plurality of arrays.

31. The method of claim 29, further comprising:

interleaving the corresponding on time periods of the corresponding switches of the plurality of arrays.

32. The method of claim 27, further comprising:

successively switching electrical current to each array of the plurality of arrays for the corresponding on time period.

33. An apparatus for controlling solid state lighting, the apparatus comprising:

a switch couplable to the solid state lighting;

a first comparator adapted to determine when a switch electrical current has reached a first predetermined current threshold;

a second comparator adapted to determine when the switch electrical current has reached a predetermined average current level; and a controller coupled to the first comparator and to the second comparator, the controller adapted to turn the switch into an on state and an off state, to determine a first on time period as a duration between either a detection of a second predetermined current threshold or the turning the switch into the on state, and the detection of the predetermined average current level; to determine a second on time period as a duration between the detection of the predetermined average current level and the detection of the first predetermined current threshold; and to determine an on time period of the switch as substantially proportional to a sum of the first on time period and the second on time period.

34. The apparatus of claim 33, wherein the controller is further adapted, when the on time period has elapsed, to turn the switch into an off state.

35. The apparatus of claim 34, wherein the controller is further adapted, subsequent to turning the switch into the off state and when a fixed time period has elapsed from having turned the switch into the on state, to turn the switch into the on state.

36. The apparatus of claim 35, wherein the controller is further adapted to generate an error signal as a difference between the second on time period and the first on time period.

37. The apparatus of claim 36, wherein the controller is further adapted to adjust the on time period proportionally to the error signal.

38. The apparatus of claim 34, wherein the controller is further adapted to determine a current off time period of the switch as a function of the first on time period and the second on time period.

39. The apparatus of claim 34, wherein the controller is further adapted to determine a current off time period of the switch as a function of the first on time period, the second on time period, and a previous off time period.

40. The apparatus of claim 34, wherein the controller is further adapted to determine a current off time period of the switch as:

$$T_{OFF}(K+1) \approx \frac{2 \cdot T_{ON2}(K) \cdot T_{OFF}(K)}{T_{ON1}(K+1) + T_{ON2}(K)},$$

in which $T_{OFF}(K+1)$ is the current off time period, $T_{ON2}(K)$ is a previous second on time period, $T_{OFF}(K)$ is a previous off time period, and $T_{ON1}(K+1)$ is a current first on time period.

41. The apparatus of claim 34, wherein the controller is further adapted to determine a current off time period of the switch as a function of a current first on time period, a previous second on time period, and a previous off time period.

42. The apparatus of claim 34, wherein the controller is further adapted to determine a current off time period of the switch as a function of a current first on time period, a previous first on time period, a previous second on time period, and a previous off time period.

43. The apparatus of claim 34, wherein the controller is further adapted to adjust a current off time period to provide that the first on time period is substantially equal to the second on time period.

44. The apparatus of claim 33, further comprising:

a gate driver circuit coupled between the controller and the switch, and wherein the controller is adapted to turn the switch on and to turn the switch off by generating a corresponding signal to the gate driver circuit.

45. The apparatus of claim 44, wherein the controller is further adapted to decrease a current off time period proportionally to a rising edge time period of the gate driver circuit.

46. The apparatus of claim 44, wherein the controller is further adapted to decrease the on time period proportionally to a falling edge time period of the gate driver circuit and a falling edge time period of the first comparator.

47. The apparatus of claim 44, wherein the controller is further adapted to adjust the second on time period proportionally to a falling edge time period of the gate driver circuit.

48. The apparatus of claim 44, wherein the controller is further adapted to decrease the second on time period proportionally to a falling edge time period of the gate driver circuit and a falling edge time period of the first comparator.

49. The apparatus of claim 44, wherein the controller is further adapted to determine a blanking time interval following turning the switch into the on state.

50. The apparatus of claim 49, further comprising:

a third comparator adapted to determine when the electrical current has reached the second predetermined current threshold.

51. The apparatus of claim 50, further comprising:

a current sensor coupled to the first, second and third comparators and to the switch.

52. The apparatus of claim 51, wherein the current sensor is embodied as a resistive circuit element.

53. The apparatus of claim 50, wherein the controller is further adapted to determine a current off time period of the switch as:

$$T_{OFF}(K+1) \approx \frac{(T_{ON1}(K)_A + T_{ON2}(K)) \cdot T_{OFF}(K)}{T_{ON1}(K+1) + T_{ON2}(K)},$$

in which $T_{OFF}(K+1)$ is the current off time period, $T_{ON1}(K)_A$ is a previous first on time period determined using the detection of the second predetermined current level, $T_{ON2}(K)$ is a previous second on time period, $T_{OFF}(K)$ is a previous off time period, and $T_{ON1}(K+1)$ is a current first on time period.

54. The apparatus of claim 50, wherein the controller is further adapted to ignore the detection of the second predetermined current threshold, the detection of the predetermined average current level, or the detection of the first predetermined current threshold during the blanking time interval.

55. The apparatus of claim 50, wherein the controller is further adapted to determine the blanking time interval as proportional to a rising edge time period of the gate driver circuit and a transient current time period.

56. The apparatus of claim 50, wherein the controller is further adapted to determine the blanking time interval as proportional to a rising edge time period of the gate driver circuit and detection of the predetermined average current level.

57. The apparatus of claim 33, wherein the controller is further adapted to adjust a brightness level of the solid state lighting by generating control signals to a driver circuit for using at least two different and opposing electrical biasing techniques.

58. The apparatus of claim 33, wherein the controller is further adapted to adjust a brightness level of the solid state lighting by generating control signals to a driver circuit to use a hysteresis of at least two electrical current amplitude levels and at least two electrical current duty cycle ratios.

59. The apparatus of claim 33, wherein the solid state lighting comprises at least one light emitting diode.

60. The apparatus of claim 59, wherein the at least one light emitting diode is coupled to a power converter, and wherein the first and second comparators are coupled to a current sensor at a comparatively low side of the power converter.

61. The apparatus of claim 33, wherein the solid state lighting comprises a plurality of arrays of a plurality of series-connected light emitting diodes, each array of the plurality of arrays is further coupled to a corresponding switch, and wherein the controller is further adapted to turn each corresponding switch into an on state and an off state.

62. The apparatus of claim 61, wherein the controller is further adapted to separately determine a corresponding first on time period, a corresponding second on time period, and a corresponding on time period as substantially proportional to the sum of the corresponding first on time period and the corresponding second on time period for each array of the plurality of arrays.

63. The apparatus of claim 62, wherein the controller is further adapted, when the corresponding on time period has elapsed, to separately turn the corresponding switch into an off state.

64. The apparatus of claim 62, wherein the controller is further adapted to separately determine a corresponding off time period for each array of the plurality of arrays.

65. The apparatus of claim 62, wherein the controller is further adapted to interleave the corresponding on time periods of the corresponding switches of the plurality of arrays.

66. The apparatus of claim 62, wherein the controller is further adapted to successively turn into an on state each corresponding switch for each array of the plurality of arrays for the corresponding on time period.

67. The apparatus of claim 33, further comprising:

a reference voltage generator coupled to the first and second comparators and adapted to provide reference voltages respectively corresponding to the first predetermined current threshold and to the predetermined average current level.

68. The apparatus of claim 33, further comprising:

an input-output interface coupled to the controller and adapted to receive an input control signal.

69. The apparatus of claim 33, wherein the apparatus is coupled to a DC-DC power converter receiving a DC input voltage or coupled to AC-DC power converter receiving a rectified AC input voltage.

70. A solid state lighting system, the system couplable to a power source, the system comprising:

a plurality of arrays of series-connected light emitting diodes;

a plurality of switches, a corresponding switch of the plurality of switches coupled to each the array of the plurality of arrays of light emitting diodes;

at least one corresponding first comparator adapted to determine when a corresponding switch electrical current has reached a corresponding first predetermined current threshold;

at least one corresponding second comparator adapted to determine when the corresponding switch electrical current has reached a corresponding predetermined average current level; and at least one controller coupled to the corresponding first comparator and to the corresponding second comparator, the controller adapted to turn the corresponding switch into an on state and an off state, to determine a corresponding first on time period as a duration between either a detection of a corresponding second predetermined current threshold or the turning the corresponding switch into the on state, and the detection of the corresponding predetermined average current level; to determine a corresponding second on time period as a duration between the detection of the corresponding predetermined average current level and the detection of the corresponding first predetermined current threshold; and to determine a corresponding on time period of the corresponding switch as substantially proportional to a sum of the corresponding first on time period and the corresponding second on time period.

71. The system of claim 70, wherein the at least one controller is further adapted, when the corresponding on time period has elapsed, to turn the corresponding switch into an off state.

72. The system of claim 70, wherein the at least one controller is further adapted, subsequent to turning the corresponding switch into the off state and when a fixed time period has elapsed from having turned the corresponding switch into the on state, to turn the corresponding switch into the on state.

73. The system of claim 72, wherein the at least one controller is further adapted to generate a corresponding error signal as a difference between the corresponding second on time period and the corresponding first on time period.

74. The system of claim 73, wherein the at least one controller is further adapted to adjust the corresponding on time period proportionally to the corresponding error signal.

75. The system of claim 70, wherein the at least one controller is further adapted to determine a corresponding current off time period of the corresponding switch as a function of the corresponding first on time period and the corresponding second on time period.

76. The system of claim 70, wherein the at least one controller is further adapted to determine a corresponding current off time period of the corresponding switch as a function of the corresponding first on time period, the corresponding second on time period, and a corresponding previous off time period.

77. The system of claim 70, wherein the at least one controller is further adapted to determine a corresponding current off time period of the corresponding switch as:

$$T_{OFF}(K+1) \approx \frac{2 \cdot T_{ON2}(K) \cdot T_{OFF}(K)}{T_{ON1}(K+1) + T_{ON2}(K)},$$

in which $T_{OFF}(K+1)$ is the corresponding current off time period, $T_{ON2}(K)$ is a corresponding previous second on time period, $T_{OFF}(K)$ is a corresponding previous off time period, and $T_{ON1}(K+1)$ is a corresponding current first on time period.

78. The system of claim 70, wherein the at least one controller is further adapted to determine a corresponding current off time period of the corresponding switch as a function of a corresponding current first on time period, a corresponding previous second on time period, and a corresponding previous off time period.

79. The system of claim 70, wherein the at least one controller is further adapted to determine a corresponding current off time period of the corresponding switch as a function of a corresponding current first on time period, a corresponding previous first on time period, a corresponding previous second on time period, and a corresponding previous off time period.

80. The system of claim 70, wherein the at least one controller is further adapted to adjust a corresponding current off time period to provide that the corresponding first on time period is substantially equal to the corresponding second on time period.

81. The system of claim 70, further comprising:

at least one corresponding gate driver circuit coupled between the at least one controller and the corresponding switch, and wherein the at least one controller is adapted to turn the corresponding switch on and to turn the corresponding switch off by generating a corresponding signal to the corresponding gate driver circuit.

82. The system of claim 81, wherein the at least one controller is further adapted to decrease a corresponding current off time period proportionally to a rising edge time period of the at least one corresponding gate driver circuit.

83. The system of claim 81, wherein the at least one controller is further adapted to decrease the corresponding on time period proportionally to a falling edge time period of the at least one corresponding gate driver circuit and a falling edge time period of the at least one first comparator.

84. The system of claim 81, wherein the at least one controller is further adapted to adjust the corresponding second on time period proportionally to a falling edge time period of the at least one corresponding gate driver circuit.

85. The system of claim 81, wherein the at least one controller is further adapted to decrease the corresponding second on time period proportionally to a falling edge time period of the at least one corresponding gate driver circuit and a falling edge time period of the at least one first comparator.

86. The system of claim 81, wherein the at least one controller is further adapted to determine a corresponding blanking time interval following turning the corresponding switch into the on state.

87. The system of claim 86, further comprising:

at least one corresponding third comparator adapted to determine when the corresponding electrical current has reached the corresponding second predetermined current threshold.

88. The system of claim 87, wherein the at least one controller is further adapted to determine a corresponding current off time period of the corresponding switch as:

$$T_{OFF}(K+1) \approx \frac{(T_{ON1}(K)_A + T_{ON2}(K)) \cdot T_{OFF}(K)}{T_{ON1}(K+1) + T_{ON2}(K)},$$

in which $T_{OFF}(K+1)$ is the corresponding current off time period, $T_{ON1}(K)_A$ is a corresponding previous first on time period determined using the detection of the second predetermined current level, $T_{ON2}(K)$ is a corresponding previous second on time period, $T_{OFF}(K)$ is a corresponding previous off time period, and $T_{ON1}(K+1)$ is a corresponding current first on time period.

89. The system of claim 87, wherein the at least one controller is further adapted to ignore the detection of the corresponding second predetermined current threshold, the detection of the corresponding predetermined average current level, or the detection of the corresponding first predetermined current threshold during the corresponding blanking time interval.

90. The system of claim 87, wherein the at least one controller is further adapted to determine the corresponding blanking time interval as proportional to a rising edge time period of the at least one corresponding gate driver circuit and a corresponding transient current time period.

91. The system of claim 87, wherein the at least one controller is further adapted to determine the corresponding blanking time interval as proportional to a rising edge time period of the at least one corresponding gate driver circuit and detection of the corresponding predetermined average current level.

92. The system of claim 70, wherein the at least one controller is further adapted to adjust a brightness level of at least one array of the plurality of arrays of light emitting diodes by generating control signals to a driver circuit for the at least one array for using at least two different and opposing electrical biasing techniques.

93. The system of claim 70, wherein the at least one controller is further adapted to adjust a brightness level of at least one array of the plurality of arrays of light emitting diodes by generating control signals to a driver circuit for the at least one array to use a hysteresis of at least two electrical current amplitude levels and at least two electrical current duty cycle ratios.

94. The system of claim 70, wherein each corresponding array of the plurality of arrays of light emitting diodes has a comparatively high voltage node and a comparatively low voltage node, and wherein the at least one first and second comparators are coupled via the corresponding switch to the comparatively low voltage node.

95. The system of claim 70, wherein the at least one controller is further adapted to interleave the corresponding on time periods of the corresponding switches of the plurality of arrays.

96. The system of claim 70, wherein the at least one controller is further adapted to successively turn into an on state each corresponding switch for each array of the plurality of arrays for the corresponding on time period.

97. The system of claim 70, further comprising:

at least one reference voltage generator coupled to the at least one corresponding first and second comparators and adapted to provide corresponding reference voltages respectively for the corresponding first predetermined current threshold and the corresponding predetermined average current level.

98. The system of claim 70, further comprising:

an input-output interface coupled to the at least one controller and adapted to receive an input control signal.

99. The system of claim 70, further comprising:

at least one rectifier couplable to the power source.

100. The system of claim 70, wherein the power source provides a DC input voltage or a rectified AC input voltage.

101. The system of claim 70, wherein when the power source provides a rectified AC input voltage, an electrical current through a corresponding switch is substantially zero when the rectified AC input voltage is below a selected or predetermined threshold.

102. The system of claim 70, wherein when the power source provides a rectified AC input voltage, the at least one controller is in an off state when the rectified AC input voltage is below a selected or predetermined threshold.

103. An apparatus for controlling solid state lighting, the apparatus comprising:

a switch couplable to the solid state lighting;

a current sensor coupled to the switch;

a first comparator adapted to determine when a switch electrical current has reached a first predetermined current threshold;

a second comparator adapted to determine when the switch electrical current has reached a predetermined average current level;

a third comparator adapted to determine when the switch electrical current has reached a second predetermined current threshold;

a reference voltage generator coupled to the first, second and third comparators and adapted to provide reference voltages respectively corresponding to the first predetermined current threshold, the second predetermined current threshold; and to the predetermined average current level;

an input-output interface adapted to receive an input control signal; and a controller coupled to the first, second and third comparators and to the input-output interface, the controller adapted to turn the switch into an on state and an off state, to determine a first on time period as a duration between either the detection of a second predetermined current threshold or the turning the switch into the on state, and the detection of the predetermined average current level; to determine a second on time period as a duration between the detection of the predetermined average current level and the detection of the first predetermined current threshold; to determine an on time period of the switch as substantially proportional to a sum of the first on time period and the second on time period; to turn the switch into an off state when the on time period has elapsed; and to determine a current off time period of the switch as a function of the first on time period, the second on time period, and a previous off time period.

* * * * *